US011400722B2

(12) United States Patent
Murayama et al.

(10) Patent No.: US 11,400,722 B2
(45) Date of Patent: Aug. 2, 2022

(54) LIQUID EJECTING APPARATUS AND MAINTENANCE METHOD FOR LIQUID EJECTING APPARATUS

(71) Applicant: SEIKO EPSON CORPORATION, Tokyo (JP)

(72) Inventors: Masato Murayama, Matsumoto (JP); Atsushi Yoshida, Matsumoto (JP); Hiroki Matsuoka, Azumino (JP); Kazushi Arafuka, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 17/170,142

(22) Filed: Feb. 8, 2021

(65) Prior Publication Data

US 2021/0245516 A1 Aug. 12, 2021

(30) Foreign Application Priority Data

Feb. 10, 2020 (JP) ..... JP2020-020369

(51) Int. Cl.
*B41J 2/165* (2006.01)

(52) U.S. Cl.
CPC .. *B41J 2/16535* (2013.01); *B41J 2002/16573* (2013.01); *B41P 2235/21* (2013.01)

(58) Field of Classification Search
CPC ..... B41J 2/16535; B41J 2/16552; B41J 2/16517; B41J 2002/16573; B41J 2002/1655; B41J 2002/16558; B41P 2235/21
See application file for complete search history.

(56) References Cited

U.S. PATENT DOCUMENTS 6,244,685 B1 * 6/2001 Yamada ..... B41J 2/16538 347/22
2010/0245466 A1 9/2010 Inoue
2017/0080714 A1 3/2017 Suzuki et al.
2017/0259575 A1 9/2017 Nakano
2018/0162120 A1 6/2018 Matsuoka
2018/0264822 A1 9/2018 Tanioku et al.
(Continued)

FOREIGN PATENT DOCUMENTS

JP H07-241996 9/1995
JP 2010-234667 10/2010
(Continued)

*Primary Examiner* — Sharon Polk
(74) *Attorney, Agent, or Firm* — Workman Nydegger

(57) ABSTRACT

A liquid ejecting apparatus including: a liquid ejecting portion configured to eject a liquid from a nozzle disposed in a nozzle surface; a wiping mechanism configured to perform a wiping operation of wiping the nozzle surface by moving a strip-shaped member configured to absorb the liquid relative to the nozzle surface in a state in which the strip-shaped member is in contact with the nozzle surface; and a control portion configured to perform a pre-wiping operation of moving the strip-shaped member relative to the nozzle surface at a speed higher than a speed for the relative movement during the wiping operation in a state in which the strip-shaped member is not in contact with the nozzle surface and is configured to be brought into contact with the liquid adhering to the nozzle surface, prior to the wiping operation of wiping the nozzle surface with the strip-shaped member.

12 Claims, 9 Drawing Sheets

(56) References Cited

U.S. PATENT DOCUMENTS

| | | | | |
|---|---|---|---|---|
| 2020/0215822 | A1* | 7/2020 | Ozaki | B41J 2/16552 |
| 2021/0138790 | A1* | 5/2021 | Nakamura | B41J 2/16517 |
| 2021/0221138 | A1* | 7/2021 | Genta | B41J 2/16552 |

FOREIGN PATENT DOCUMENTS

| | | | | |
|---|---|---|---|---|
| JP | 2016-104530 | | 6/2016 | |
| JP | 2017-056696 | | 3/2017 | |
| JP | 6330555 | B2 * | 5/2018 | B41J 2/16544 |
| JP | 2018-094743 | | 6/2018 | |
| JP | 2018118444 | A * | 8/2018 | |
| JP | 2018-154123 | | 10/2018 | |

* cited by examiner

LIQUID EJECTING APPARATUS AND MAINTENANCE METHOD FOR LIQUID EJECTING APPARATUS

The present application is based on, and claims priority from JP Application Serial Number 2020-020369, filed Feb. 10, 2020, the disclosure of which is hereby incorporated by reference herein in its entirety.

BACKGROUND

1. Technical Field

The present disclosure relates to a liquid ejecting apparatus such as a printer and a maintenance method for a liquid ejecting apparatus.

2. Related Art

As described in JP-A-2018-154123, there is a printer as an example of a liquid ejecting apparatus configured to eject a liquid from a liquid ejecting head as an example of a liquid ejecting portion to perform printing. The printer includes a wiping-off mechanism as an example of a wiping mechanism configured to wipe off a nozzle surface of the liquid ejecting head, and the nozzle surface is wiped off with a web as an example of a strip-shaped member.

The wiping-off mechanism removes contaminants adhering to the nozzle surface by using the web to wipe off the nozzle surface a plurality of times. However, the time required for wiping off the nozzle surface increases as the number of repetitions of wiping off the nozzle surface increases.

SUMMARY

To solve the aforementioned problem, there is provided a liquid ejecting apparatus including: a liquid ejecting portion configured to eject a liquid from a nozzle disposed in a nozzle surface; a wiping mechanism configured to perform a wiping operation of wiping the nozzle surface by moving a strip-shaped member configured to absorb the liquid ejected by the liquid ejecting portion relative to the nozzle surface in a state in which the strip-shaped member is in contact with the nozzle surface; and a control portion configured to perform a pre-wiping operation of moving the strip-shaped member relative to the nozzle surface at a speed higher than a speed for the relative movement during the wiping operation in a state in which the strip-shaped member is not in contact with the nozzle surface and is configured to be brought into contact with the liquid adhering to the nozzle surface, prior to the wiping operation of wiping the nozzle surface with the strip-shaped member.

To solve the aforementioned problem, there is provided a maintenance method for a liquid ejecting apparatus including a liquid ejecting portion configured to eject a liquid from a nozzle disposed in a nozzle surface, and a wiping mechanism configured to perform a wiping operation of wiping the nozzle surface by moving a strip-shaped member configured to absorb the liquid ejected by the liquid ejecting portion relative to the nozzle surface in a state in which the strip-shaped member is in contact with the nozzle surface, the method including: prior to a wiping operation of wiping the nozzle surface with the strip-shaped member, performing a pre-wiping operation of moving the strip-shaped member relative to the nozzle surface at a speed higher than a speed for the relative movement during the wiping operation in a state in which the strip-shaped member is not in contact with the nozzle surface and is configured to be brought into contact with the liquid adhering to the nozzle surface.

DESCRIPTION OF EXEMPLARY EMBODIMENTS

Figure 1:
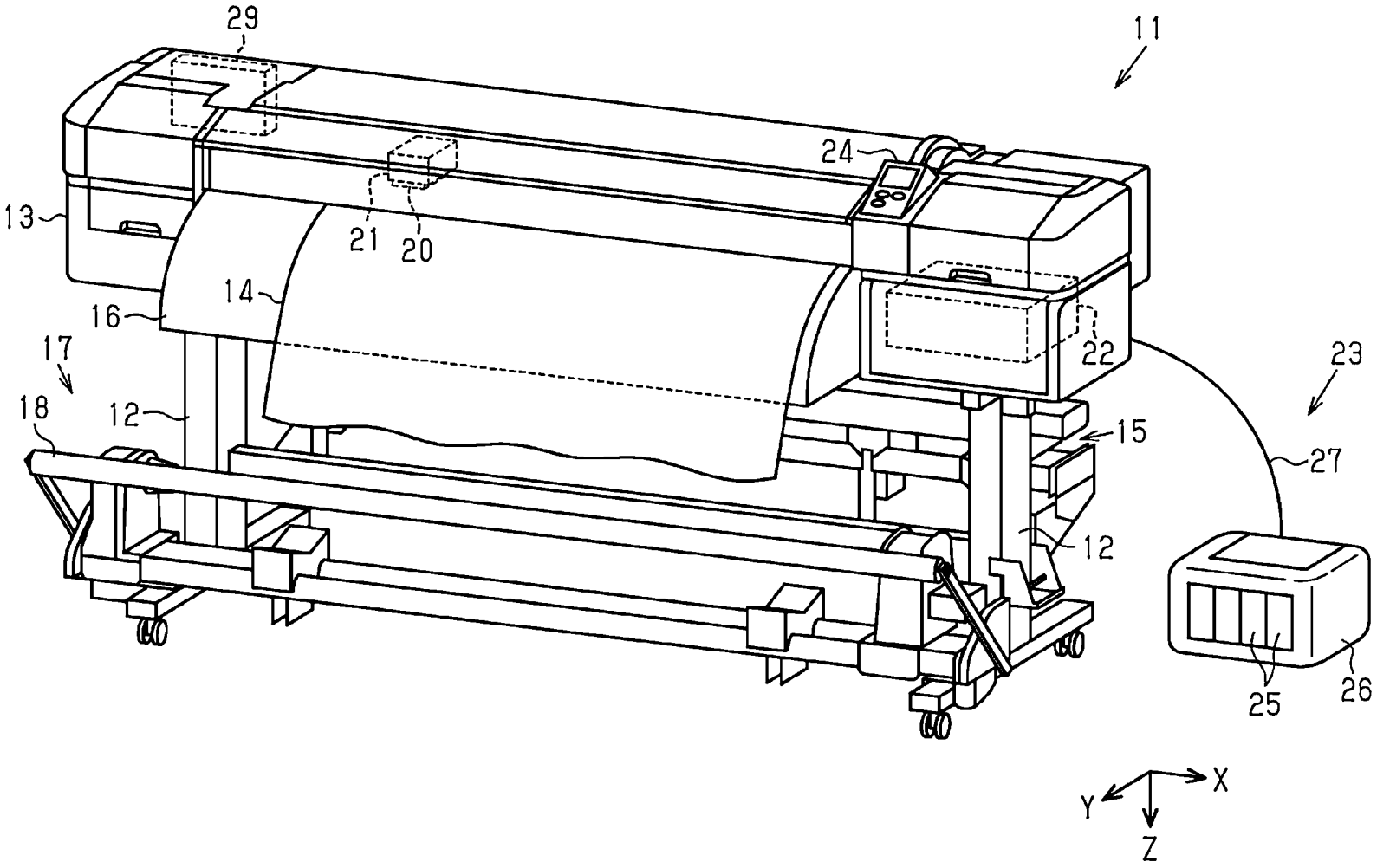
FIG. 1 is a perspective view of a liquid ejecting apparatus according to an embodiment.

Hereinafter, an embodiment of a liquid ejecting apparatus and a maintenance method for a liquid ejecting apparatus will be described with reference to the drawings. The liquid ejecting apparatus is, for example, an ink jet printer configured to perform printing by ejecting ink, which is an example of a liquid, onto a medium such as paper.

In the drawings, the direction of gravity is represented by a Z axis, and directions that follow a horizontal surface are represented by an X axis and a Y axis on the assumption that the liquid ejecting apparatus 11 is placed on the horizontal surface. The X axis, the Y axis, and the Z axis perpendicularly intersect each other. In the following description, the direction along the X axis will also be referred to as a width direction X, the direction along the Y axis will also be referred to as a depth direction Y, and the direction along the Z axis will also be referred to as a gravity direction Z.

As illustrated in FIG. 1, the liquid ejecting apparatus 11 may include a pair of legs 12 and a housing 13 assembled on the legs 12. The liquid ejecting apparatus 11 may include a feeding portion 15 that unwinds and feeds a medium 14 wound and overlapped in a roll shape, a guide portion 16 that guides the medium 14 discharged from the housing 13, and a collecting portion 17 that winds and collects the medium 14. The liquid ejecting apparatus 11 may include a tension-applying mechanism 18 that applies a tension to the medium 14 collected by the collecting portion 17.

The liquid ejecting apparatus 11 includes a liquid ejecting portion 20 capable of ejecting a liquid, a carriage 21 that causes the liquid ejecting portion 20 to move, and a maintenance unit 22 that performs maintenance of the liquid ejecting portion 20. The liquid ejecting apparatus 11 may include a liquid supply device 23 that supplies a liquid to the liquid ejecting portion 20 and an operation panel 24 operated by a user. The carriage 21 reciprocates the liquid ejecting portion 20 along the X axis. The liquid ejecting portion 20 ejects the liquid supplied through the liquid supply device 23 while moving and performs printing on the medium 14.

The liquid supply device 23 includes an attachment portion 26 to which a plurality of liquid accommodating elements 25 accommodating a liquid are detachably attached and a supply flow path 27 through which the liquid is supplied from the liquid accommodating element 25 attached to the attachment portion 26 to the liquid ejecting portion 20.

The liquid ejecting apparatus 11 includes a control portion 29 configured to control operations of the liquid ejecting apparatus 11. The control portion 29 includes, for example, a CPU, memory, and the like. The control portion 29 controls the liquid ejecting portion 20, the liquid supply device 23, the maintenance unit 22, and the like by the CPU executing a program stored in the memory.

Figure 2:
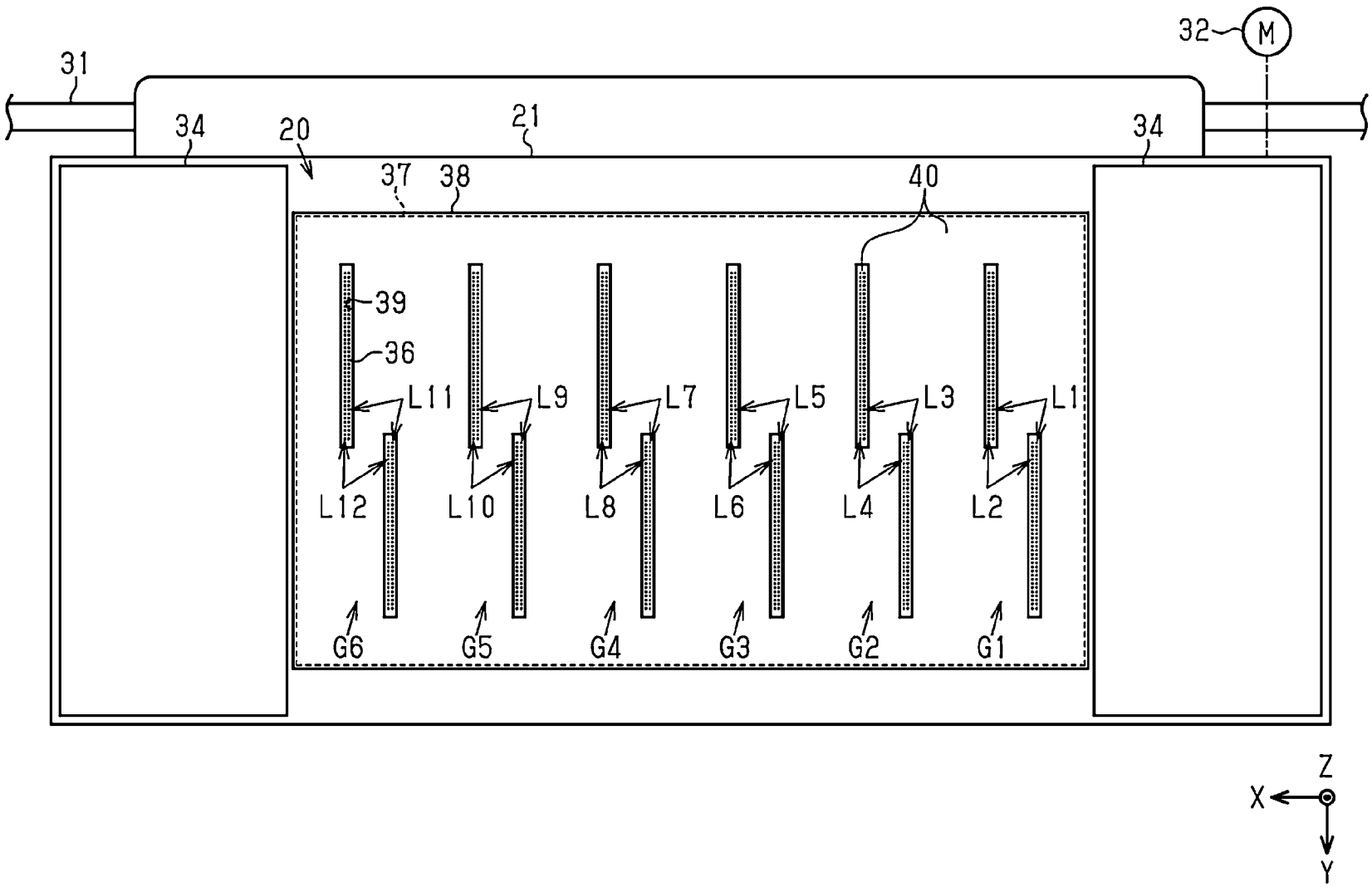
FIG. 2 is a schematic bottom view of a liquid ejecting portion and a carriage.

As illustrated in FIG. 2, the liquid ejecting apparatus 11 may include a guide shaft 31 for supporting the carriage 21 and a carriage motor 32 for moving the carriage 21. The guide shaft 31 extends in the width direction X. The control portion 29 causes the carriage 21 and the liquid ejecting portion 20 to reciprocate along the guide shaft 31 by controlling the drive of the carriage motor 32.

The liquid ejecting apparatus 11 may include a rectification portion 34 held below the carriage 21. When rectification portions 34 are provided on both sides of the liquid ejecting portion 20 in the width direction X, it is possible to facilitate rectification of an air flow in the surroundings of the liquid ejecting portion 20 that reciprocates along the X axis.

The liquid ejecting portion 20 may include a nozzle forming member 37 in which a plurality of nozzles 36 are formed and a cover member 38 that covers a part of the nozzle forming member 37. The cover member 38 is configured of a metal such as stainless steel, for example. A plurality of through-holes 39 penetrating through the cover member 38 in the gravity direction Z are formed in the cover member 38. The cover member 38 covers a side of the nozzle forming member 37 on which the nozzles 36 are formed such that the nozzles 36 are exposed from the through-holes 39. The nozzle surface 40 is formed to include the nozzle forming member 37 and the cover member 38. Specifically, the nozzle surface 40 is configured of the nozzle forming member 37 exposed from the through-holes 39 and the cover member 38. The liquid ejecting portion 20 can eject a liquid from the nozzles 36 disposed in the nozzle surface 40.

Multiple openings of the nozzles 36 configured to eject a liquid are aligned at constant intervals in one direction in the liquid ejecting portion 20. The plurality of nozzles 36 configure nozzle arrays. In the present embodiment, the openings of the nozzles 36 are aligned in the depth direction Y and configure a first nozzle array L1 to a twelfth nozzle array L12. Nozzles 36 configuring a nozzle array eject the same type of liquid. A nozzle 36 positioned on the furthest side in the depth direction Y and a nozzle 36 positioned on the front side in the depth direction Y among the nozzles 36 configuring one nozzle array are formed with positional deviations in the width direction X.

The first nozzle array L1 to the twelfth nozzle array L12 are aligned such that every two arrays are located closer to each other in the width direction X. In the present embodiment, two nozzle arrays aligned closer to each other will be referred to as a nozzle group. A first nozzle group G1 to a sixth nozzle group G6 are disposed at constant intervals in the width direction X in the liquid ejecting portion 20.

Specifically, the first nozzle group G1 includes a first nozzle array L1 for ejecting magenta ink and a second nozzle array L2 for ejecting yellow ink. The second nozzle group G2 includes a third nozzle array L3 for ejecting cyan ink and a fourth nozzle array L4 for ejecting black ink. The third nozzle group G3 includes a fifth nozzle array L5 for ejecting light cyan ink and a sixth nozzle array L6 for ejecting light magenta ink. The fourth nozzle group G4 includes a seventh nozzle array L7 and an eighth nozzle array L8 for ejecting a processing solution. The fifth nozzle group G5 includes a ninth nozzle array L9 for ejecting black ink and a tenth nozzle array L10 for ejecting cyan ink. The sixth nozzle group G6 includes an eleventh nozzle array L11 for ejecting yellow ink and a twelfth nozzle array L12 for ejecting magenta ink.

Next, the maintenance unit 22 will be described.

Figure 3:
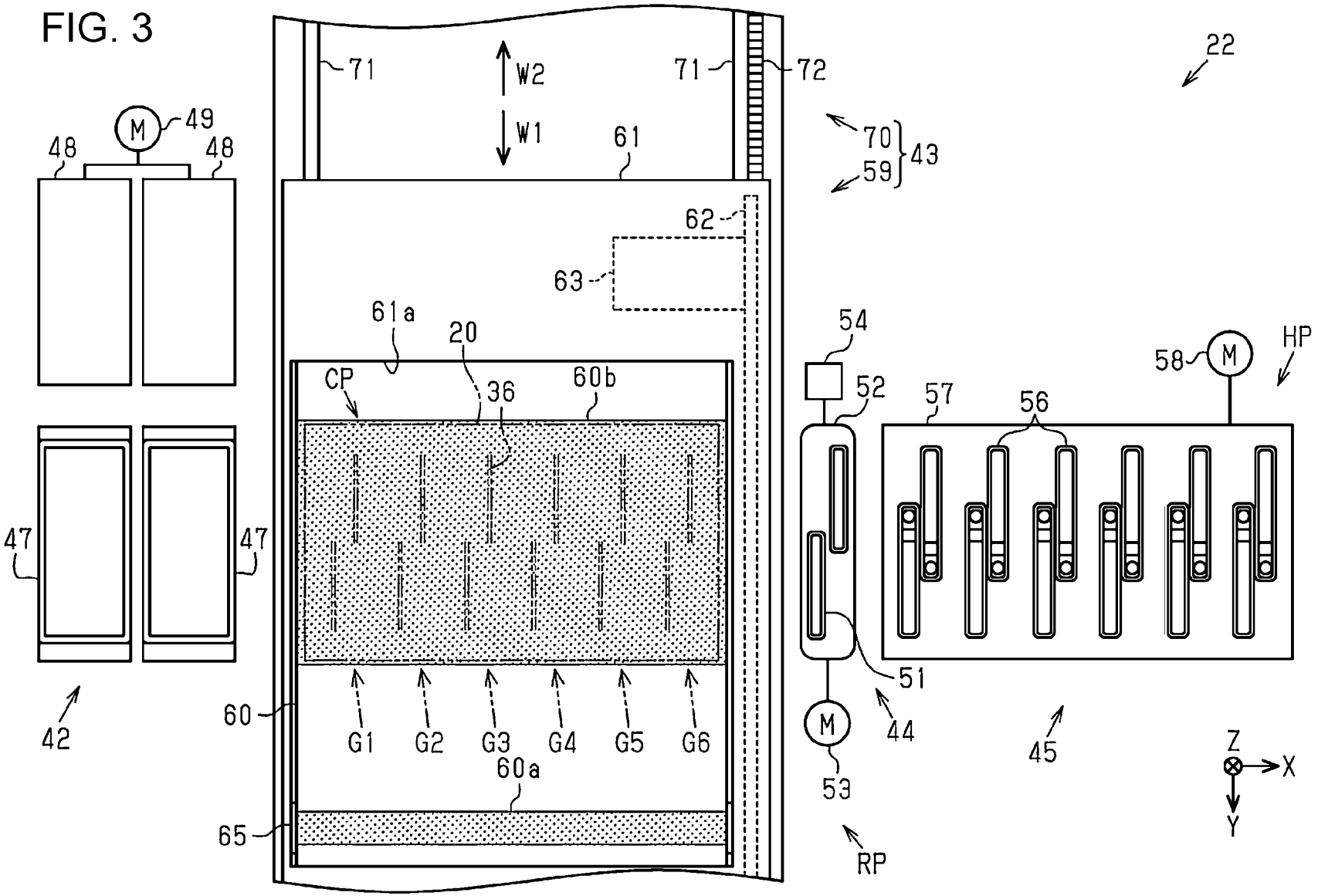
FIG. 3 is a schematic plan view of a maintenance unit.

As illustrated in FIG. 3, the maintenance unit 22 has a flushing device 42, a wiping mechanism 43, a suctioning device 44, and a capping device 45 aligned in the width direction X. The upper part of the capping device 45 serves as a home position HP of the liquid ejecting portion 20. The home position HP is a start point of movement of the liquid ejecting portion 20. The upper part of the wiping mechanism 43 serves as a cleaning position CP of the liquid ejecting portion 20. In FIG. 3, the liquid ejecting portion 20 positioned at the cleaning position CP is illustrated by a two-dotted dashed line.

The flushing device 42 receives the liquid ejected by the liquid ejecting portion 20 through flushing. Flushing means maintenance of ejecting the liquid as a waste solution for the purpose of preventing and solving clogging of the nozzles 36.

The flushing device 42 includes a liquid receiving portion 47 that receives the liquid ejected by the liquid ejecting portion 20 for flushing, a lid member 48 for covering an opening of the liquid receiving portion 47, and a lid motor 49 for moving the lid member 48. The flushing device 42 may include a plurality of liquid receiving portions 47 and a plurality of lid members 48. The control portion 29 may select a liquid receiving portion 47 depending on liquid type. The flushing device 42 in the present embodiment includes two liquid receiving portions 47, and one of the liquid receiving portions 47 receives a plurality of color inks ejected by the liquid ejecting portion 20 through flushing while the other of the liquid receiving portions 47 receives a processing solution ejected by the liquid ejecting portion 20 through flushing. The liquid receiving portion 47 may accommodate a moisturizer.

The lid member 48 moves between a covering position, at which the lid member 48 covers the opening of the liquid receiving portion 47, which is not illustrated, and an exposure position, at which the lid member 48 opens to expose the liquid receiving portion 47, which is illustrated in FIG. 3, through driving of the lid motor 49. When the flushing is not performed, the lid member 48 moves to the covering position to curb drying of the accommodated moisturizer and the received liquid.

The suctioning device 44 includes suctioning caps 51, a holding element for the suctioning 52 that holds the suctioning caps 51, a suctioning motor 53 that reciprocates the holding element for the suctioning 52 along the Z axis, and a pressure reducing mechanism 54 that reduces the pressure in the suctioning caps 51. The suctioning caps 51 move between a contact position and an evacuation position with movement of the holding element for the suctioning 52 caused by the suctioning motor 53. The contact position is a position at which the suctioning caps 51 come into contact with the liquid ejecting portion 20 and surround the nozzles 36. The evacuation position is a position to which the suctioning caps 51 are separated from the liquid ejecting portion 20.

The suctioning caps 51 may be configured to collectively surround all the nozzles 36, may be configured to surround at least one nozzle group, or may be configured to surround some nozzles 36 of nozzles 36 configuring the nozzle groups. The suctioning device 44 in the present embodiment surrounds one nozzle group from among the first nozzle group G1 to the sixth nozzle group G6 with the two suctioning caps 51.

The liquid ejecting apparatus 11 may cause the liquid ejecting portion 20 to be positioned above the suctioning device 44, cause the suctioning cap 51 to be positioned at the contact position to surround one nozzle group, and perform suctioning cleaning of reducing the pressure inside the suctioning caps 51 and causes the nozzles 36 to discharge the liquid. In other words, the suctioning device 44 may receive the liquid discharged through the suctioning cleaning.

The capping device 45 has a standby cap 56, a holding element for the leaving 57 that holds the standby cap 56, and a leaving motor 58 that reciprocates the holding element for the leaving 57 along the Z axis. The standby cap 56 moves upward or downward with movement of the holding element for the leaving 57 caused by the leaving motor 58. The standby cap 56 moves to the capping position, which is an upper position, from a separate position, which is a lower position, and comes into contact with the liquid ejecting portion 20 stopping at the home position HP.

The standby cap 56 positioned at the capping position surrounds the openings of the nozzles 36 configuring the first nozzle group G1 to the sixth nozzle group G6. In this manner, maintenance in which the standby cap 56 surrounds the openings of the nozzles 36 will be referred to as standby capping. The standby capping is a type of capping. The standby capping curbs drying of the nozzles 36.

The standby cap 56 may be configured to collectively surround all the nozzles 36, may be configured to surround at least one nozzle group, or may be configured to surround some nozzles 36 among the nozzles 36 configuring the nozzle groups.

Next, the wiping mechanism 43 will be described.

As illustrated in FIG. 3, the wiping mechanism 43 includes a wiping body 59 and a track portion 70 that movably supports the wiping body 59. The wiping body 59 may include a strip-shaped member 60 capable of absorbing a liquid ejected by the liquid ejecting portion 20, a case 61 that accommodates the strip-shaped member 60, and a power transmission mechanism 62 and a wiping motor 63 provided in the case 61. The wiping body 59 moves on the track portion 70 between a standby position WP illustrated in FIG. 4 and a receiving position RP illustrated in FIG. 3.

The wiping body 59 positioned at the standby position WP moves in a first wiping-off direction W1 that is parallel to the Y axis and is then directed to the receiving position RP by the wiping motor 63 being driven in reverse. The wiping body 59 positioned at the receiving position RP moves in a second wiping-off direction W2 that is opposite to the first wiping-off direction W1 and is then directed to the standby position WP by the wiping motor 63 being driven forward. The control portion 29 controls the movement of the wiping body 59 between the standby position WP and the receiving position RP through control of the driving of the wiping motor 63. The control portion 29 may control the moving speed of the wiping body 59 through controlling the rotation speed of the wiping motor 63.

The strip-shaped member 60 has a contact region 60*a* that can come into contact with the nozzle surface 40 and a receiving region 60*b* that can receive the liquid discharged from the nozzles 36. The case 61 has an opening 61*a* that exposes the contact region 60*a* and the receiving region 60*b*. The size of the strip-shaped member 60 in the width direction X may be equal to or greater than the size of the nozzle surface 40. In this case, it is possible to efficiently perform maintenance of the liquid ejecting portion 20.

The wiping mechanism 43 can perform a wiping operation of wiping the nozzle surface 40 by moving the contact region 60*a* of the strip-shaped member 60 relative to the nozzle surface 40 in a state in which the contact region 60*a* is in contact with the nozzle surface 40. The wiping mechanism 43 performs the wiping operation in the process in which the wiping body 59 moves between the standby position WP and the receiving position RP.

The receiving region 60*b* faces the nozzle surface 40 when the wiping body 59 is positioned at the receiving position RP and the liquid ejecting portion 20 is positioned at the cleaning position CP. The liquid ejecting apparatus 11 may perform pressure cleaning and discharge cleaning of causing the nozzles 36 to discharge a pressurized liquid in this state. The discharge cleaning is maintenance in which the nozzles 36 are caused to discharge the liquid in order to empty the inside of the liquid ejecting portion 20 and the flow path for supplying the liquid to the liquid ejecting portion 20. The amount of liquid adhering to the nozzle surface 40 through the discharge cleaning is likely to be larger than the amount of liquid adhering to the nozzle surface 40 through the pressure cleaning. The receiving region 60*b* in the present embodiment receives the liquid discharged through the pressure cleaning and the discharge cleaning.

Figure 4:
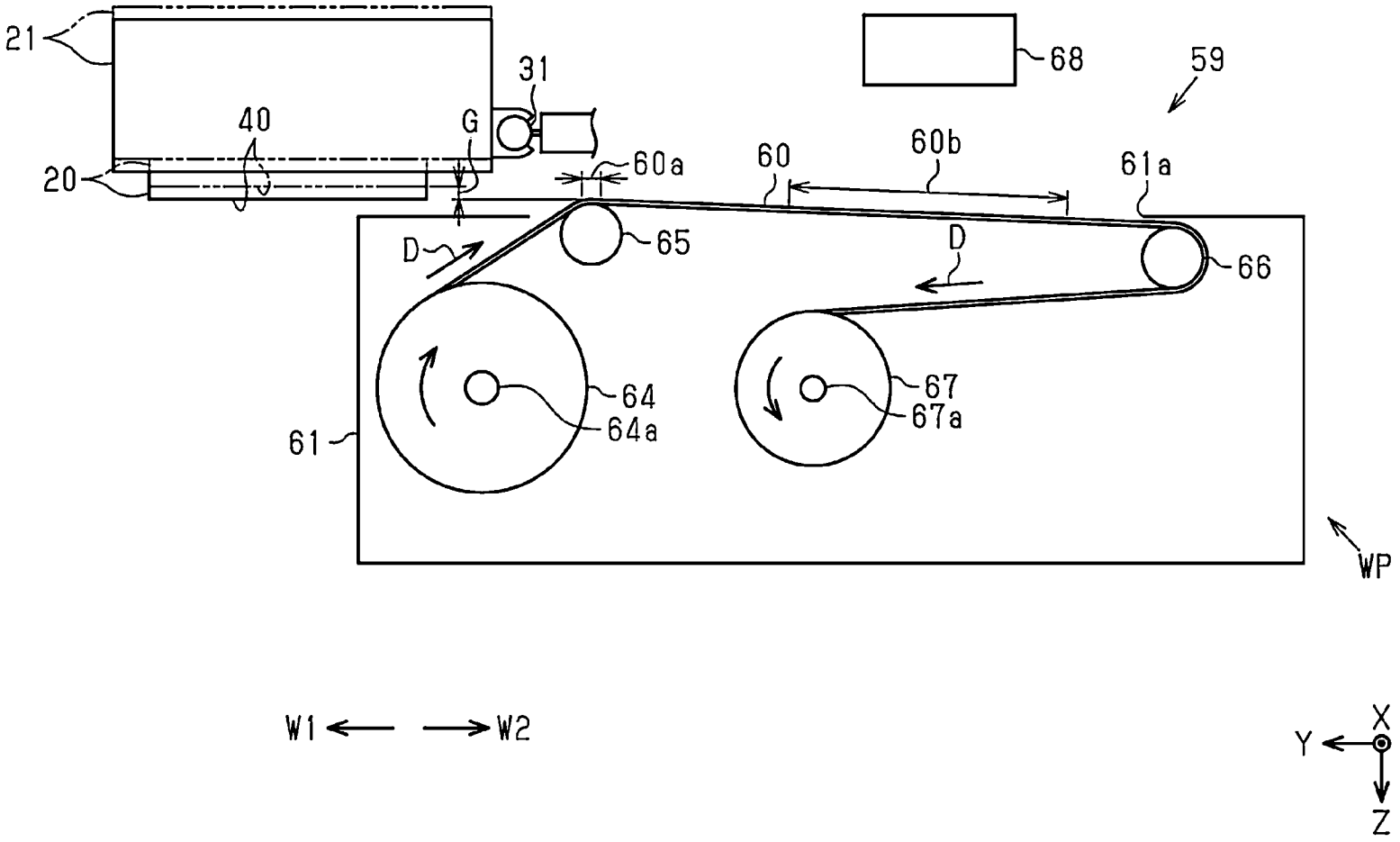
FIG. 4 is a schematic side view of a wiping body located at a standby position.

As illustrated in FIG. 4, the wiping body 59 includes an unwinding portion 64 that has an unwinding shaft 64*a*, a pressing roller 65 that presses the contact region 60*a*, a downstream roller 66 that forms the receiving region 60*b* between the downstream roller 66 and the pressing roller 65, and a winding portion 67 that has a winding shaft 67*a*. The case 61 rotatably supports the unwinding shaft 64*a*, the pressing roller 65, the downstream roller 66, and the winding shaft 67*a* with the X axis used as an axial direction.

The unwinding portion 64 and the winding portion 67 hold the strip-shaped member 60 in a state in which the strip-shaped member 60 is wound in a roll shape. The winding shaft 67*a* in the present embodiment is driven by the wiping motor 63 to rotate. The strip-shaped member 60 unwound and fed from the unwinding portion 64 is transported to the winding portion 67 along a transport path. The winding portion 67 winds the strip-shaped member 60 around the winding shaft 67*a* in a roll shape. The winding portion 67 causes the portion of the strip-shaped member 60 unwound from the unwinding portion 64 to move in a moving direction D by winding the strip-shaped member 60. The moving direction D is a direction along the transport path of the strip-shaped member 60 and is a direction from the unwinding portion 64 disposed upstream toward the winding portion 67 disposed downstream.

The pressing roller 65 and the downstream roller 66 are provided along the transport path of the strip-shaped member 60. The pressing roller 65 presses the strip-shaped member 60 unwound from the unwinding portion 64 upward from the lower side to cause the strip-shaped member 60 to project from the opening 61*a*. The downstream roller 66 is disposed downstream of the pressing roller 65 in the moving direction D and below the pressing roller 65.

By the strip-shaped member 60 being unwound from the unwinding portion 64, an upstream region that is continuous with the contact region 60*a* is formed between the unwinding portion 64 and the pressing roller 65, and a downstream region that is continuous with the contact region 60*a* is formed between the pressing roller 65 and the downstream roller 66. In this case, an angle formed between the nozzle surface 40 and the upstream region and an angle formed between the nozzle surface 40 and the downstream region when the contact region 60*a* comes into contact with the nozzle surface 40 may be set to be equal to or greater than 3 degrees and equal to or less than 30 degrees.

As illustrated in FIG. 4, the liquid ejecting apparatus 11 may include a gap-changing mechanism 68 capable of changing a gap G between the nozzle surface 40 and the contact region 60*a* in the Z-axis direction. The gap-changing mechanism 68 reciprocates the guide shaft 31 along the Z axis, thereby causing the liquid ejecting portion 20 and the carriage 21 to be located at a wiping position illustrated by the solid line in FIG. 4 and a pre-wiping position illustrated by the two-dotted dashed line in FIG. 4.

The wiping position is a position at which the nozzle surface 40 is located at the same position as the contact region 60*a* in the gravity direction Z or a position at which the nozzle surface 40 is located between the contact region 60*a* and a surface of the case 61 where the opening 61*a* is formed and the gap G is equal to or less than zero. The pre-wiping position is a position at which the nozzle surface 40 is located above the contact region 60*a* and the gap G is greater than zero and smaller than the maximum thickness of the liquid adhering to the nozzle surface 40. The maximum thickness of the liquid is a distance from the lower end of the liquid to the nozzle surface 40 when the maximum amount of liquid that can be held in the nozzle surface 40 adheres to the nozzle surface 40.

The control portion 29 according to the present embodiment can bring the strip-shaped member 60 into a state, in which the strip-shaped member 60 is not in contact with the nozzle surface 40 and can come into contact with the liquid adhering to the nozzle surface 40, by positioning the liquid ejecting portion 20 at the pre-wiping position. The control portion 29 can bring the strip-shaped member 60 into a state in which the strip-shaped member 60 can come into contact with the nozzle surface 40 by positioning the liquid ejecting portion 20 at the wiping position.

Figure 5:
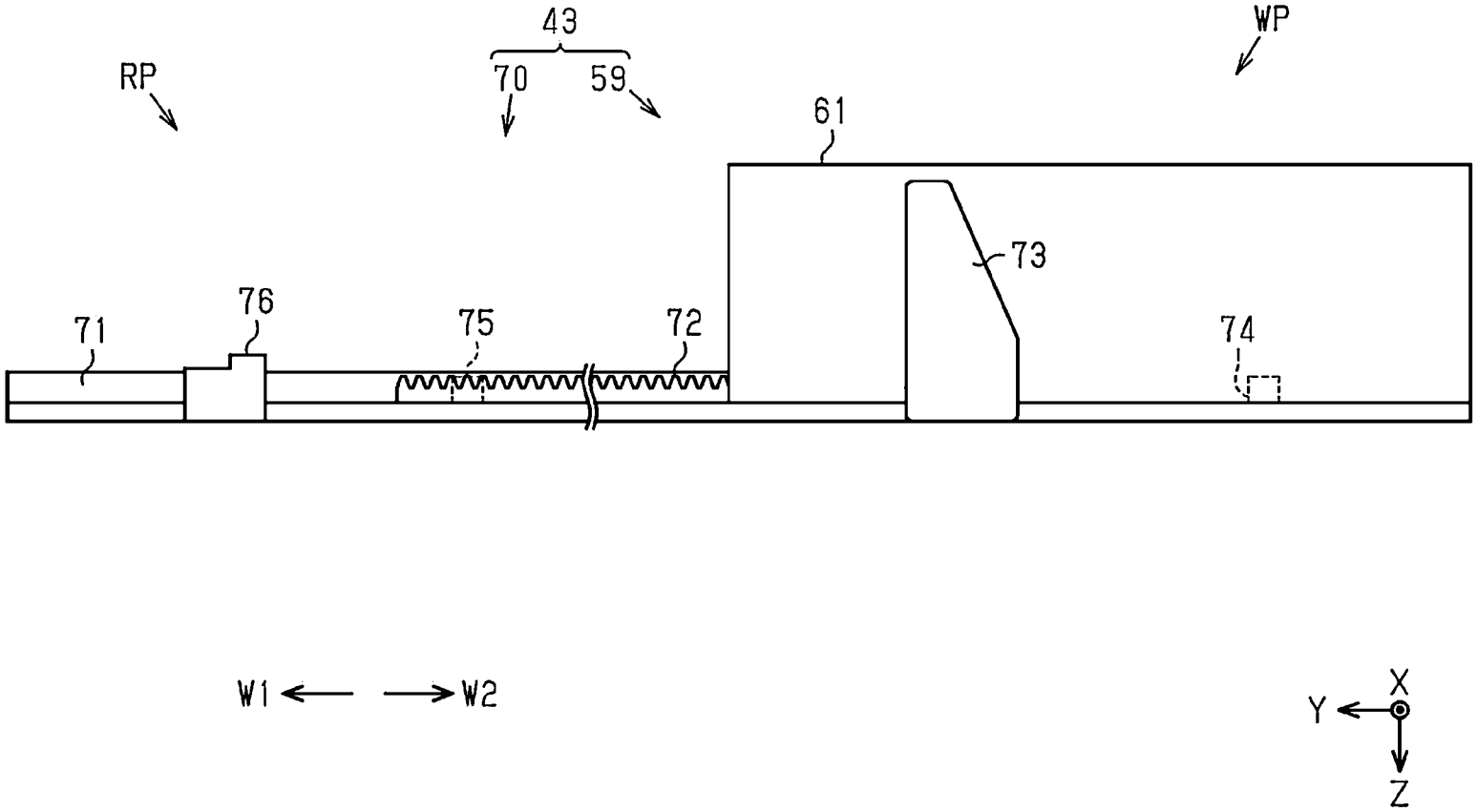
FIG. 5 is a schematic side view of a wiping mechanism with the wiping body located at the standby position.

As illustrated in FIG. 5, the track portion 70 may include a pair of rails 71 extending along the Y axis and a rack 72 extending in the Y axis. The track portion 70 may include a first pressing portion 73 and a first locking portion 74 provided at the standby position WP and a second locking portion 75 and a second pressing portion 76 provided at the receiving position RP.

The first locking portion 74 and the first pressing portion 73 are engaged with the wiping body 59 located at the standby position WP. The second locking portion 75 and the second pressing portion 76 are engaged with the wiping body 59 located at the receiving position RP.

Next, a detailed structure of the power transmission mechanism 62 will be described.

Figure 6:
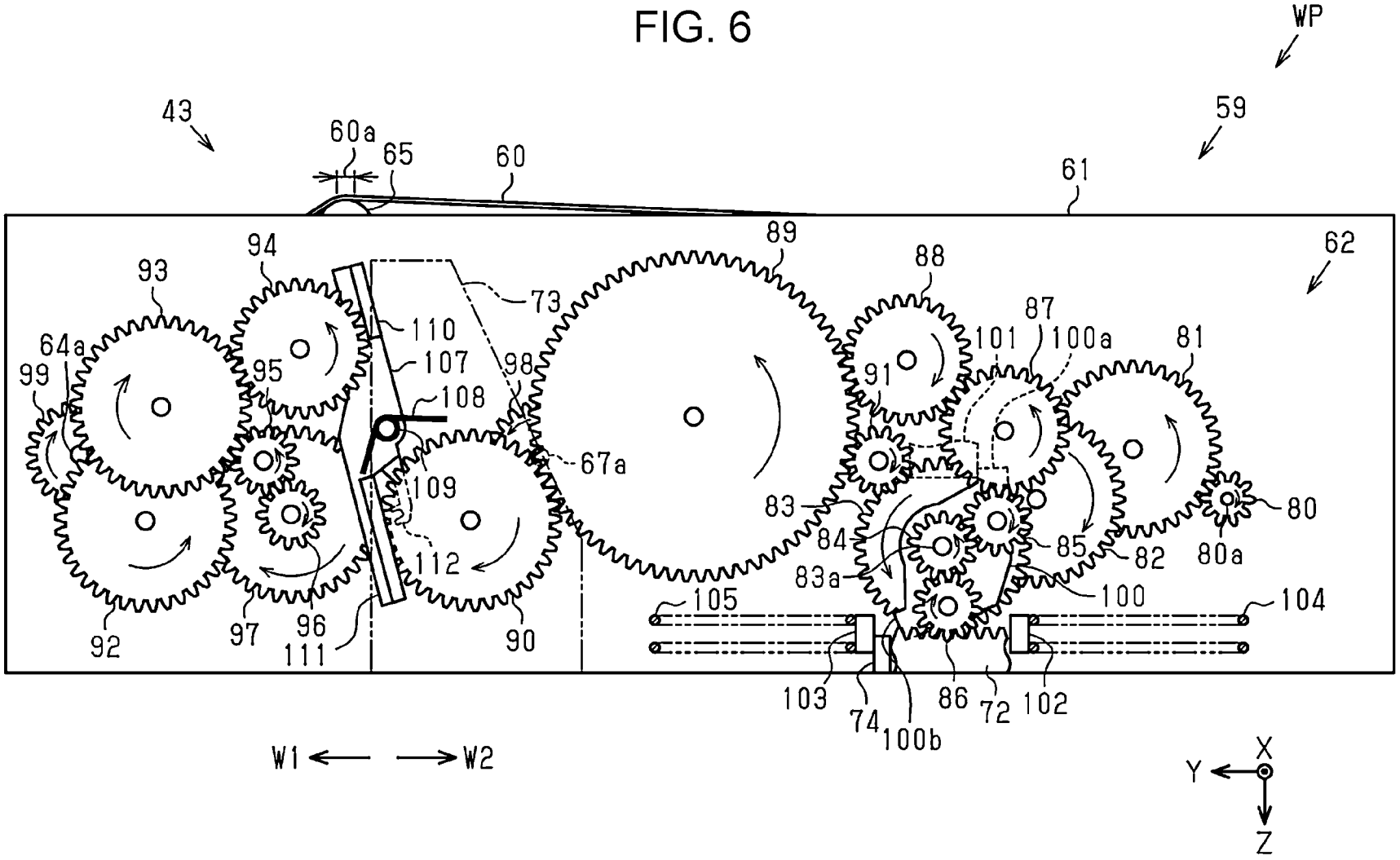
FIG. 6 is a schematic view of a power transmission mechanism in a state in which the wiping body is located at the standby position.

As illustrated in FIG. 6, the power transmission mechanism 62 according to the present embodiment includes a drive gear 80, a first gear 81 to a seventeenth gear 97, a winding gear 98, and an unwinding gear 99. The drive gear 80 is secured to a drive shaft 80*a* of the wiping motor 63. The winding gear 98 is secured to the winding shaft 67*a*. The unwinding gear 99 is secured to the unwinding shaft 64*a*. The third gear 83 and the fourth gear 84 are secured to the gear shaft 83*a* and integrally rotate. The sixteenth gear 96 and the seventeenth gear 97 are integrally provided. The power transmission mechanism 62 may include a load-applying portion (not illustrated) that applies a load to the fourteenth gear 94.

The power transmission mechanism 62 includes a rotation member 100 that is rotatable about the gear shaft 83*a* and a first abutting portion 101 to a third abutting portion 103 that restricts rotation of the rotation member 100. The power transmission mechanism 62 includes a first spring 104 that presses the second abutting portion 102 in the depth direction Y and a second spring 105 that presses the third abutting portion 103 in the opposite direction of the depth direction Y. The fifth gear 85 and the sixth gear 86 are provided at the rotation member 100.

The rotation member 100 has a first protruding portion 100*a* and a second protruding portion 100*b* provided with a phase deviation of about 180 degrees around the gear shaft 83*a* at the center. The first protruding portion 100*a* abuts the first abutting portion 101 or the second abutting portion 102 through the rotation of the rotation member 100. The second protruding portion 100*b* abuts the first abutting portion 101 or the third abutting portion 103 through the rotation of the rotation member 100.

The power transmission mechanism 62 includes a torque limiter provided between the third gear 83 and the rotation member 100, which is not illustrated. The torque limiter causes the rotation member 100 to rotate in the same direction as that of the third gear 83 when the third gear 83 rotates, and the torque limiter separates the third gear 83 from the rotation member 100 when the rotation of the rotation member 100 is limited and a load increases.

The power transmission mechanism 62 includes a stopper 107 and a third spring 108 that pushes the stopper 107. The stopper 107 is provided to be able to move between a winding position illustrated in FIG. 6 and a tooth alignment position illustrated in FIG. 7 through rotation about a rotation shaft 109. The third spring 108 presses the stopper 107 toward the tooth alignment position.

The stopper 107 has an upper abutting portion 110 located at an upper portion, a lower abutting portion 111 located at a lower portion, and a meshing portion 112 that can be meshed with the seventeenth gear 97. When the stopper 107 is located at the tooth alignment position, the meshing portion 112 is meshed with the seventeenth gear 97 to restrict rotation of the seventeenth gear 97. When the stopper 107 is located at the winding position, the meshing portion 112 is separated from the seventeenth gear 97 and allows rotation of the seventeenth gear 97. The upper abutting portion 110 and the lower abutting portion 111 partially project from the case 61 through a window provided in a side surface of the case 61, which is not illustrated.

Next, winding of the strip-shaped member 60 and moving of the wiping body 59 will be described.

As illustrated in FIG. 6, the control portion 29 causes the wiping motor 63 to drive forward, thereby causing the wiping body 59 to wind the strip-shaped member 60 in a state in which the wiping body 59 is located at the standby position WP. When the wiping body 59 is positioned at the standby position WP, the upper abutting portion 110 is pressed by the first pressing portion 73, and the stopper 107 is thus located at the winding position. The rotation of the rotation member 100 is restricted by the first protruding portion 100*a* abutting the first abutting portion 101.

Power from the wiping motor 63 is transmitted to the drive gear 80, the first gear 81, the second gear 82, the third gear 83, the fourth gear 84, the fifth gear 85, the seventh gear 87, the eighth gear 88, the ninth gear 89, the tenth gear 90, and the winding gear 98 in this order and causes the winding shaft 67*a* to rotate. When the winding shaft 67*a* rotates, and the strip-shaped member 60 is wound around the winding shaft 67*a*, the unwinding shaft 64*a* around which the strip-shaped member 60 is wound in a roll shape rotates. Therefore, the power from the wiping motor 63 is transmitted to the unwinding gear 99, the twelfth gear 92, the thirteenth gear 93, the fifteenth gear 95, the sixteenth gear 96, and the seventeenth gear 97 in this order via the strip-shaped member 60.

At this time, the fourth gear 84 is meshed with the sixth gear 86 while the sixth gear 86 is not meshed with the rack 72. The eleventh gear 91 is also meshed with the ninth gear 89. The fourteenth gear 94 is also meshed with the thirteenth gear 93. Therefore, the sixth gear 86, the eleventh gear 91, and the fourteenth gear 94 also rotate.

Figure 7:
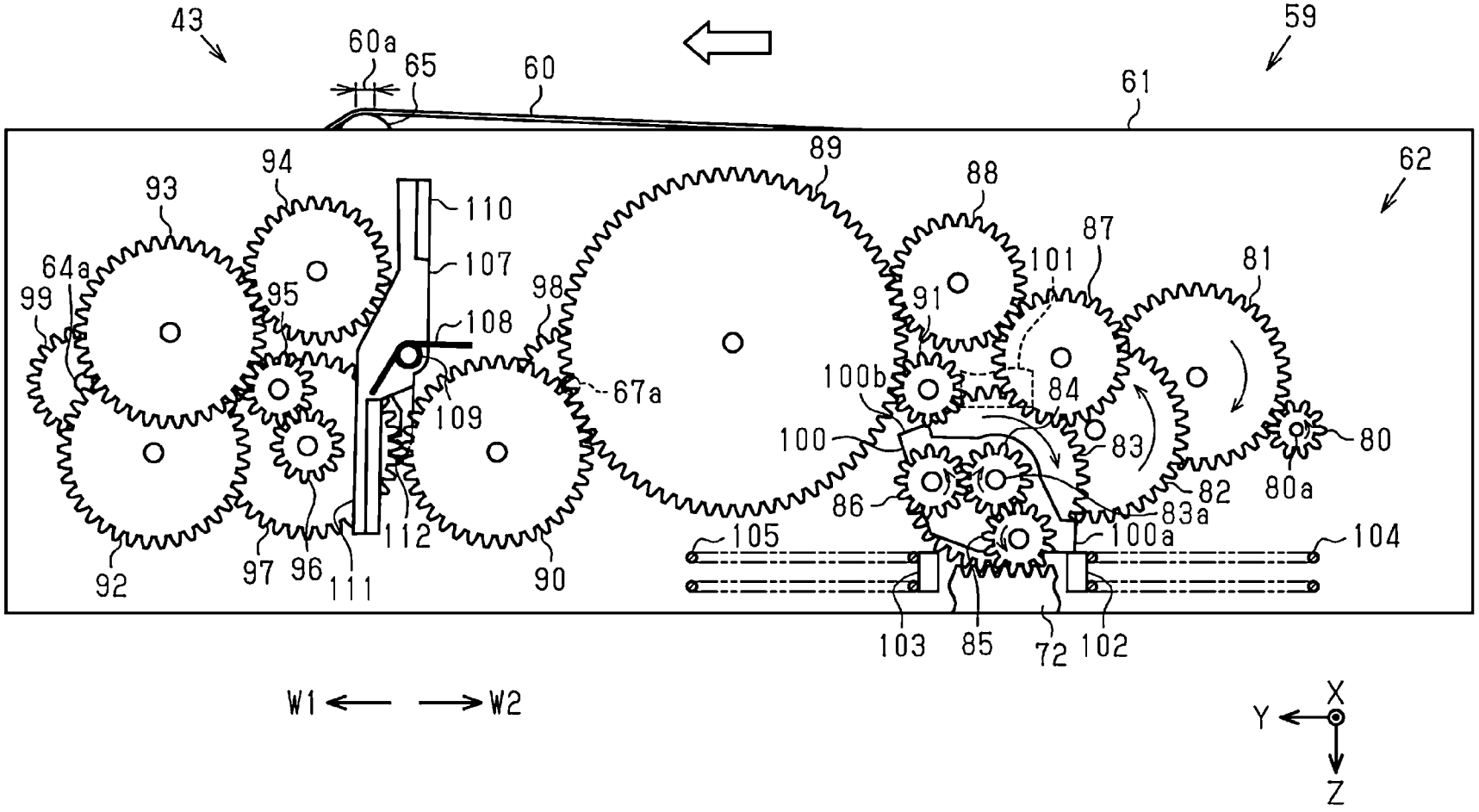
FIG. 7 is a schematic view of the power transmission mechanism in a state in which the wiping body moves in a first wiping-off direction.

As illustrated in FIG. 7, the control portion 29 causes the wiping motor 63 to drive in reverse and causes the wiping body 59 to move in the first wiping-off direction W1. In other words, the power of the wiping motor 63 is transmitted to the drive gear 80, the first gear 81, the second gear 82, the third gear 83, the fourth gear 84, and the fifth gear 85 in this order. The rotation member 100 rotates in the clockwise direction in FIG. 7. The rotation of the rotation member 100 is restricted by the first protruding portion 100*a* abutting the second abutting portion 102. In this state, the fifth gear 85 is meshed with the rack 72. Therefore, the power transmission mechanism 62 causes the wiping body 59 to move by causing the fifth gear 85 to rotate in a state in which the fifth gear 85 is meshed with the rack 72.

When the wiping body 59 is separated from the standby position WP, the stopper 107 is pushed by the third spring 108 and moves to the tooth alignment position. The meshing portion 112 of the stopper 107 located at the tooth alignment position is meshed with the seventeenth gear 97 to restrict the rotation of the seventeenth gear 97. In this manner, the rotation of the unwinding shaft 64*a* is restricted.

Figure 8:
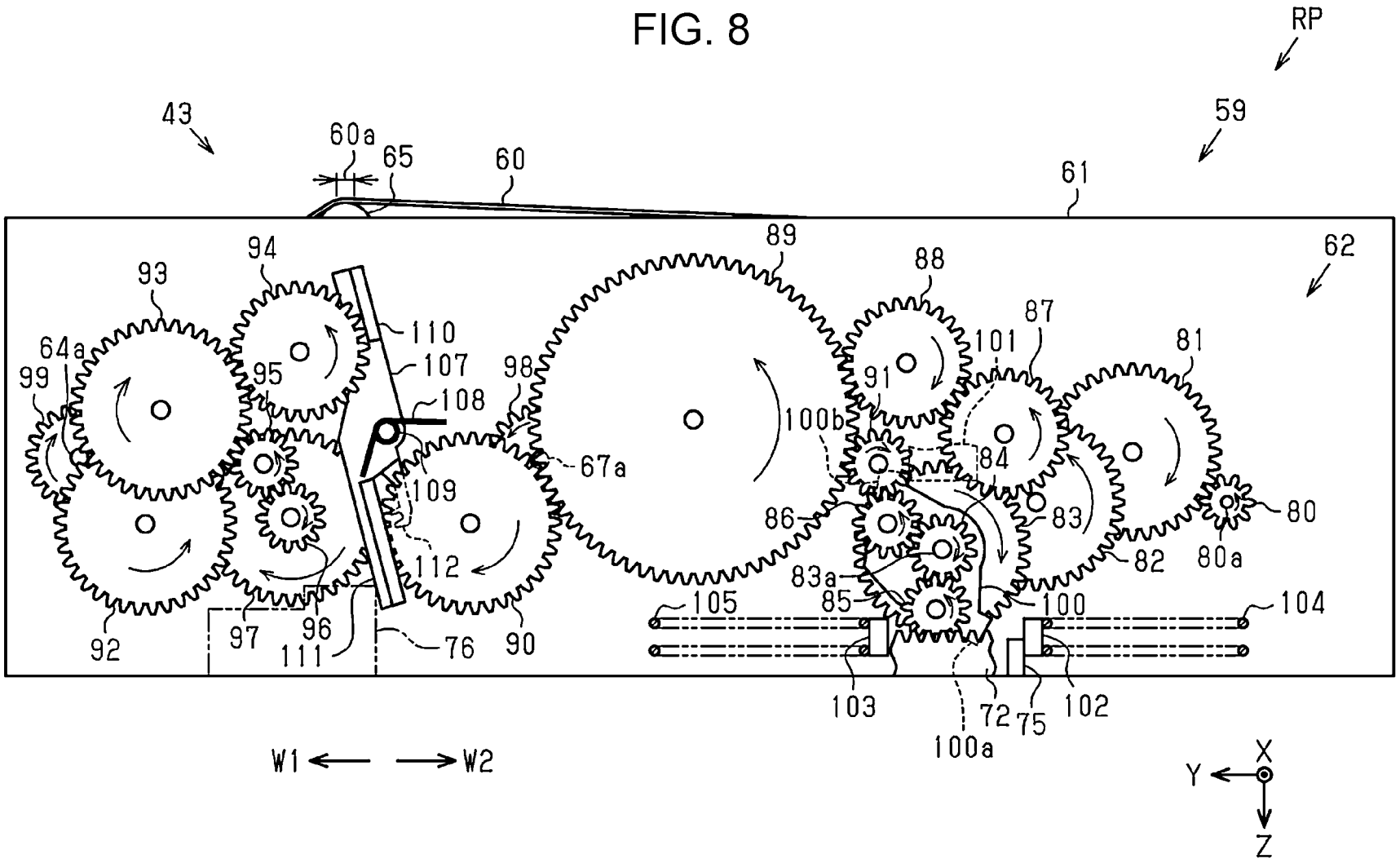
FIG. 8 is a schematic view of the power transmission mechanism in a state in which the wiping body is located at a receiving position.

As illustrated in FIG. 8, when the wiping body 59 reaches the receiving position RP, the second locking portion 75 abuts the second abutting portion 102 and pushes the second abutting portion 102. In this manner, the first protruding portion 100*a* is separated from the second abutting portion 102, and the rotation member 100 rotates in the clockwise direction illustrated in FIG. 8. The rotation of the rotation member 100 is restricted by the second protruding portion 100*b* abutting the first abutting portion 101. The lower abutting portion 111 is pushed by the second pressing portion 76, and the stopper 107 is located at the winding position.

The power of the wiping motor 63 is transmitted to the drive gear 80, the first gear 81, the second gear 82, the third gear 83, the fourth gear 84, the sixth gear 86, the eleventh gear 91, the ninth gear 89, the tenth gear 90, and the winding gear 98 in this order. Through the rotation of the winding shaft 67*a*, the strip-shaped member 60 is wound around the winding shaft 67*a*, and the unwinding shaft 64*a* rotates. Therefore, the power of the wiping motor 63 is transmitted to the unwinding gear 99 via the strip-shaped member 60 and is then transmitted to the unwinding gear 99, the twelfth gear 92, the thirteenth gear 93, the fifteenth gear 95, the sixteenth gear 96, and the seventeenth gear 97 in this order.

At this time, the fourth gear 84 is meshed with the fifth gear 85 while the fifth gear 85 is not meshed with the rack 72. The eighth gear 88 is meshed with the ninth gear 89, and the seventh gear 87 is meshed with the eighth gear 88. Therefore, the fifth gear 85, the seventh gear 87, and the eighth gear 88 also rotate.

Figure 9:
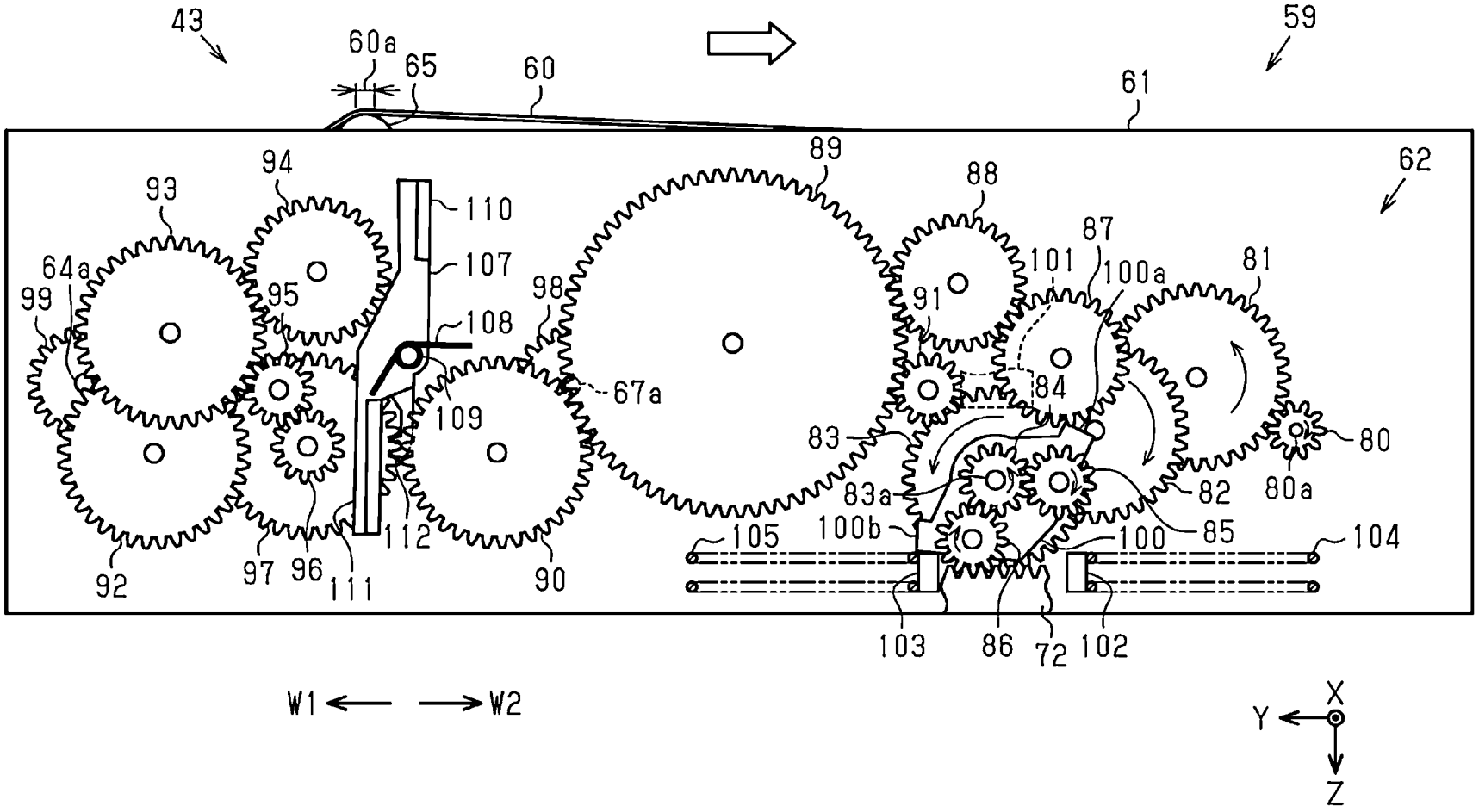
FIG. 9 is a schematic view of the power transmission mechanism in a state in which the wiping body moves in a second wiping-off direction.

As illustrated in FIG. 9, the control portion 29 causes the wiping motor 63 to drive forward and causes the wiping body 59 to move in the second wiping-off direction W2. In other words, the power of the wiping motor 63 is transmitted to the drive gear 80, the first gear 81, the second gear 82, the third gear 83, the fourth gear 84, and the sixth gear 86 in this order. The rotation member 100 rotates in the counterclockwise direction in FIG. 9. The rotation of the rotation member 100 is restricted by the second protruding portion 100*b* abutting the third abutting portion 103. In this state, the sixth gear 86 is meshed with the rack 72. Therefore, the power transmission mechanism 62 causes the sixth gear 86 to rotate in the state in which the sixth gear 86 is meshed with the rack 72 and thus causes the wiping body 59 to move. When the wiping body 59 is separated from the receiving position RP, the stopper 107 is pushed by the third spring 108 and moves to the tooth alignment position.

As illustrated in FIG. 6, when the wiping body 59 reaches the standby position WP, the first locking portion 74 abuts the third abutting portion 103 and pushes the third abutting portion 103. In this manner, the second protruding portion 100*b* is separated from the third abutting portion 103, and the rotation member 100 rotates in the counterclockwise direction illustrated in FIG. 6. The rotation of the rotation member 100 is restricted by the first protruding portion 100*a* abutting the first abutting portion 101.

Next, maintenance of the liquid ejecting apparatus 11 performed by the control portion 29 will be described in accordance with the effects of the present embodiment.

As illustrated in FIG. 4, the control portion 29 performs a wiping operation of wiping the nozzle surface 40 with the strip-shaped member 60 by causing the wiping body 59 to move in a state in which the liquid ejecting portion 20 is located at the wiping position illustrated by the solid line. By causing the wiping body 59 to move in a state in which the liquid ejecting portion 20 is located at the pre-wiping position illustrated by the two-dotted dashed line, the control portion 29 performs the pre-wiping operation of causing the strip-shaped member 60 to move relative to the nozzle surface 40 in a state in which the strip-shaped member 60 is not in contact with the nozzle.

The control portion 29 may cause the wiping body 59 to move at different speeds for the wiping operation and for the pre-wiping operation. The control portion 29 performs the pre-wiping operation by causing the strip-shaped member 60 to move relative to the nozzle surface 40 at a speed higher than that for the relative movement during the wiping operation. By causing the winding shaft 67*a* to rotate, the wiping mechanism 43 can perform the winding operation of winding the strip-shaped member 60 to allow the unused portion of the strip-shaped member 60 to be brought into a state in which the unused portion can come into contact with the nozzle surface 40.

The wiping operation, the pre-wiping operation, and the winding operation may be performed in combination. The control portion 29 may perform the pre-wiping operation prior to the wiping operation. The control portion 29 according to the present embodiment can perform a first wiping-off operation, a second wiping-off operation, and a third wiping-off operation. The first wiping-off operation is an operation of performing the pre-wiping operation prior to the wiping operation. The second wiping-off operation is an operation of performing the wiping operation without performing the pre-wiping operation. The third wiping-off operation is an operation of performing the pre-wiping operation, the winding operation, and then the wiping operation. In other words, the control portion 29 performs the pre-wiping operation and the wiping operation in order when the first wiping-off operation is selected. The control portion 29 performs only the wiping operation when the second wiping-off operation is selected. The control portion 29 performs the pre-wiping operation, the winding operation, and the wiping operation in order when the third wiping-off operation is selected.

The control portion 29 may select any one of the first wiping-off operation to the third wiping-off operation in accordance with the amount of liquid adhering to the nozzle surface 40. The control portion 29 may perform the second wiping-off operation when the amount of liquid adhering to the nozzle surface 40 is smaller than the amount thereof when the first wiping-off operation is performed. The control portion 29 may perform the third wiping-off operation when the amount of liquid adhering to the nozzle surface 40 is larger than the amount thereof when the first wiping-off operation is performed. The control portion 29 according to the present embodiment performs the first wiping-off operation after the pressure cleaning, performs the second wiping-off operation after printing, and performs the third wiping-off operation after the discharge cleaning.

First, the first wiping-off operation will be described.

As illustrated in FIG. 3, the control portion 29 performs the pressure cleaning with the wiping body 59 located at the receiving position RP and with the liquid ejecting portion 20 located at the cleaning position CP and the pre-wiping position.

When the pressure cleaning is complete, the control portion 29 performs the pre-wiping operation. The control portion 29 causes the wiping motor 63 to drive forward and causes the wiping body 59 to move in the second wiping-off direction W2 from the receiving position RP toward the standby position WP. At this time, the control portion 29 causes the wiping body 59 to move at a second moving speed, which is higher than a first moving speed.

The contact region 60*a* of the strip-shaped member 60 passes below the nozzle surface 40 when moving to the standby position WP. At this time, the contact region 60*a* is not in contact with the nozzle surface 40, and the contact region 60*a* comes into contact with the liquid adhering to the nozzle surface 40. Through the pre-wiping operation, the liquid adhering to the nozzle surface 40 is absorbed by the contact region 60*a*.

When the contact region 60*a* passes through the nozzle surface 40 and the pre-wiping operation is complete, the control portion 29 performs the wiping operation. The control portion 29 causes the liquid ejecting portion 20 to move to the wiping position. The control portion 29 causes the wiping motor 63 to drive in reverse and thus causes the wiping body 59 to move in the first wiping-off direction W1. In other words, after the pre-wiping operation, the control portion 29 causes the nozzle surface 40 and the strip-shaped member 60 to relatively move in the direction opposite to the direction of the relative movement at the time of the pre-wiping operation to perform the wiping operation.

The switching of the driving of the wiping motor 63 may be performed after the wiping body 59 is caused to move to the standby position WP or may be performed midway through the moving of the wiping body 59 in the second wiping-off direction W2. Compared with a case in which the wiping body 59 is caused to move to the standby position WP, it is possible to shorten the time required for the first wiping-off operation by causing the wiping body 59 to move in the first wiping-off direction W1 before the wiping body 59 moving in the second wiping-off direction W2 reaches the standby position WP.

The control portion 29 performs the wiping operation by causing the strip-shaped member 60 and the nozzle surface 40 to relatively move in a state in which the contact region 60*a* is in contact with the nozzle surface 40. At this time, the control portion 29 causes the wiping body 59 to move at the first moving speed, which is lower than the second moving speed. In other words, in the pre-wiping operation performed first in the first wiping-off operation, the strip-shaped member 60 and the nozzle surface 40 relatively move at a speed higher than that of the wiping operation performed later. Therefore, the time required for the pre-wiping operation is shorter than the time required for the wiping operation.

Next, the second wiping-off operation will be described.

When printing is performed by ejecting ink from the nozzles 36, mist may adhere to the nozzle surface 40. The amount of liquid adhering to the nozzle surface 40 due to the printing is smaller than the amount of liquid adhering to the nozzle surface 40 due to the pressure cleaning. The control portion 29 may perform the second wiping-off operation midway or after the printing.

As illustrated in FIG. 4, the control portion 29 causes the wiping body 59 to be located at the standby position WP and causes the liquid ejecting portion 20 to be located at the cleaning position CP and the wiping position. The control portion 29 causes the wiping motor 63 to drive in reverse and thus causes the wiping body 59 to move in the first wiping-off direction W1. At this time, the control portion 29 causes the wiping body 59 to move at the first moving speed, which is lower than the second moving speed. The control portion 29 performs the wiping operation by causing the strip-shaped member 60 and the nozzle surface 40 to relatively move in a state in which the contact region 60*a* is in contact with the nozzle surface 40.

Next, the third wiping-off operation will be described.

As illustrated in FIG. 3, the control portion 29 performs the discharge cleaning with the wiping body 59 located at the receiving position RP and with the liquid ejecting portion 20 located at the cleaning position CP and the pre-wiping position.

When the discharge cleaning is complete, the control portion 29 performs the winding operation between the pre-wiping operation and the wiping operation similarly to the first wiping-off operation. Specifically, the control portion 29 causes the wiping motor 63 to drive forward and thus causes the wiping body 59 to move in the second wiping-off direction W2 to perform the pre-wiping operation. At this time, the control portion 29 causes the wiping body 59 to move at a second moving speed, which is higher than a first moving speed. In the third wiping-off operation, the control portion 29 continues to cause the wiping motor 63 to drive forward even after the contact region 60*a* passes through the nozzle surface 40 and the pre-wiping operation is complete.

As illustrated in FIG. 6, when the wiping body 59 moves to the standby position WP, then the power of the wiping motor 63 is transmitted to the winding shaft 67*a*, and the strip-shaped member 60 is wound around the winding shaft 67*a*. The control portion 29 continues to cause the wiping motor 63 to drive forward even after the wiping body 59 moves to the standby position WP, thereby performing the winding operation of winding the strip-shaped member 60. In the winding operation, the portion of the strip-shaped member 60 that absorbs and holds the liquid in the pre-wiping operation is caused to move in the moving direction D.

When the winding operation of the strip-shaped member 60 is completed, then the control portion 29 performs the wiping operation. The control portion 29 causes the liquid ejecting portion 20 to be located at the wiping position. The control portion 29 causes the wiping motor 63 to drive backward and thus causes the wiping body 59 to move in the first wiping-off direction W1.

Effects of the present embodiment will be described.

1. The control portion 29 causes the strip-shaped member 60 and the nozzle surface 40 to relatively move to successively perform the pre-wiping operation and the wiping operation. The pre-wiping operation causes the strip-shaped member 60 and the nozzle surface 40 to relatively move at a speed higher than the speed for the wiping operation. The time required for the pre-wiping operation is shorter than the time required for the wiping operation. The time required when the pre-wiping operation and the wiping operation are successively performed is shorter than the time required when the wiping operation is successively performed. It is thus possible to reduce the time increasing when the wiping of the nozzle surface 40 is performed a plurality of times.

2. For example, when the directions in which the strip-shaped member 60 and the nozzle surface 40 relatively move are the same in the pre-wiping operation and the wiping operation, it is necessary for the strip-shaped member 60 and the nozzle surface 40 to return to the original positions after performing the pre-wiping operation and to then perform the wiping operation. In this regard, the direction in which the strip-shaped member 60 and the nozzle surface 40 relatively move in the pre-wiping operation and the direction in which the strip-shaped member 60 and the nozzle surface 40 relatively move in the wiping operation are opposite. Therefore, the strip-shaped member 60 and the nozzle surface 40 can perform the relative movement for the wiping operation from the positions at which the strip-shaped member 60 and the nozzle surface 40 end the pre-wiping operation and can thus efficiently perform the pre-wiping operation and the wiping operation.

3. When the amount of liquid adhering to the nozzle surface 40 is small, the liquid adhering to the nozzle surface 40 may be sufficiently wiped off merely by the wiping operation. In this regard, the control portion 29 performs the wiping operation without performing the pre-wiping operation when the amount of liquid adhering to the nozzle surface 40 is small. Therefore, it is possible to efficiently perform the wiping in accordance with the state of the nozzle surface 40.

4. When the amount of liquid adhering to the nozzle surface 40 is large, there may be a case in which the liquid cannot be sufficiently wiped off through the pre-wiping operation and the wiping operation. In this regard, the control portion 29 performs the pre-wiping operation, the winding operation, and the wiping operation in order when the amount of liquid adhering to the nozzle surface 40 is large. The portion of the strip-shaped member 60 that has absorbed the liquid in the pre-wiping operation is wound through the winding operation. In other words, it is possible to reduce the liquid remaining on the nozzle surface 40 even when the amount of liquid adhering to the nozzle surface 40 is large, by performing the wiping operation with a portion of the strip-shaped member 60 that is different from the portion used in the pre-wiping operation.

The present embodiment can also be performed with the following modifications. The present embodiment and the following modification examples can be performed in combination within a range in which technical conflicts do not occur.

The wiping mechanism 43 may include two pressing rollers 65 aligned in the moving direction D along the transport path of the strip-shaped member 60, and a region between the two pressing rollers 65 may be used as the contact region 60*a*.

The control portion 29 may select which wiping-off operation among the first wiping-off operation, the second wiping-off operation, and the third wiping-off operation is to be performed in accordance with the state of the liquid ejecting portion 20. For example, the control portion 29 may perform first pressure cleaning with a large discharge amount and second pressure cleaning with a smaller discharge amount than that of the first pressure cleaning. The adhesion amount of liquid adhering to the nozzle surface 40 after the first pressure cleaning is larger than the adhesion amount of liquid adhering to the nozzle surface 40 after the second pressure cleaning. Thus, the control portion 29 may perform the third wiping-off operation after the first pressure cleaning and may perform the first wiping-off operation after the second pressure cleaning. For example, the liquid ejecting apparatus 11 may include a sensor for detecting the amount of liquid adhering to the nozzle surface 40, and the control portion 29 may select a wiping-off operation based on a detection result of the sensor.

The control portion 29 may set the direction in which the wiping body 59 is caused to move in the pre-wiping operation and the direction in which the wiping body 59 is caused to move in the wiping operation to be the same direction.

The control portion 29 may cause the strip-shaped member 60 and the nozzle surface 40 to relatively move by causing the nozzle surface 40 to move. The control portion 29 may cause the strip-shaped member 60 and the nozzle surface 40 to relatively move by causing both the strip-shaped member 60 and the nozzle surface 40 to move. For example, the control portion 29 may perform the pre-wiping operation by causing the wiping body 59 to move and may perform the wiping operation by causing the liquid ejecting portion 20 to move.

The control portion 29 may perform the winding operation of winding the strip-shaped member 60 after the first wiping-off operation, the second wiping-off operation, and the third wiping-off operation are complete. The control portion 29 may perform the winding operation before the first wiping-off operation, the second wiping-off operation, and the third wiping-off operation are started.

The wiping mechanism 43 may include a body moving mechanism capable of reciprocating the wiping body 59 along the Z axis. The control portion 29 may change the gap G between the nozzle surface 40 and the contact region 60*a* by causing the wiping body 59 to move.

The wiping mechanism 43 may include a roller moving mechanism capable of reciprocating the pressing roller 65 along the Z axis. The control portion 29 may change the gap G between the nozzle surface 40 and the contact region 60*a* by causing the pressing roller 65 to move.

The wiping mechanism 43 may include a roller rotation mechanism capable of changing the position of the contact region 60*a* in the gravity direction Z by causing the pressing roller 65 to rotate. For example, the pressing roller 65 may be an eccentric roller with a shaft deviating from the center. The pressing roller 65 may have an elliptical columnar shape.

The liquid ejecting apparatus 11 may be a liquid ejecting apparatus configured to eject a liquid other than the ink. States of the liquid ejected from the liquid ejecting apparatus as a minute amount of liquid droplets include a particle form, a teardrop form, and a form with a string-like tail. The liquid described here may be any material that can be ejected by the liquid ejecting apparatus. For example, the liquid may be any substance in a liquid-phase state and includes fluids such as a liquid-form substance with high or low viscosity, a sol, a gel water, another inorganic solvent, an organic solvent, a solution, a liquid resin, a liquid metal, and a molten metal liquid. The liquid includes not only a liquid in one form of a substance but also includes particles a functional material made of solid such as a pigment or metal particles and dissolved, dispersed, or mixed in a solvent and the like. Representative examples of the liquid include the ink described above in the present embodiment, a liquid crystal, and the like. Here, the ink includes various liquid compositions such as a typical water-based ink, an oil-based ink, a gel ink, and a hot melt ink. Specific examples of the liquid ejecting apparatus include a device configured to eject a liquid which contains, in a dispersed or dissolved form, an electrode material, a coloring material, or the like that is used for manufacturing a liquid crystal display, an electroluminescence display, a surface light-emitting display, or a color filter, for example. The liquid ejecting apparatus may be a device configured to eject a bioorganic material used for producing a biochip, a device configured to eject a liquid that is used as a precision pipette and serves as a sample, a printing machine, a micro-dispenser, or the like. The liquid ejecting apparatus may be a device that ejects a lubricant to a precision machine such as a clock or a camera or a device that ejects, onto a substrate, a transparent resin solution such as an ultraviolet curable resin in order to form a micro-hemispherical lens, an optical lens, and the like used in an optical communication device or the like. The liquid ejecting apparatus may be a device configured to eject an acid or alkaline etching solution or the like to etch a substrate or the like.

The strip-shaped member 60 may be impregnated with an impregnating solution in advance. The impregnating solution preferably contains a penetrant and a humidifier.

The wiping mechanism 43 may supply the wiping solution to the contact region 60*a* of the strip-shaped member 60 prior to at least either the pre-wiping operation or the wiping operation. In this case, the wiping mechanism 43 may include a supply mechanism for supplying the wiping solution, and the wiping solution may be supplied to the contact region 60*a* by the control portion 29 controlling the supply mechanism. In this manner, the pre-wiping operation and the wiping operation can be performed with the strip-shaped member 60 to which the wiping solution has been supplied.

The wiping solution caused to contain additives contained in the impregnating solution may be supplied to the strip-shaped member 60.

As the wiping solution, pure water may be employed, or a liquid obtained by causing pure water to contain a preservative may be employed. As the wiping solution, a liquid with surface tension higher than the surface tension of the liquid used by the liquid ejecting portion 20 may be employed. For example, a liquid with surface tension of equal to or greater than 40 mN/m and equal to or less than 80 mN/m may be employed, or a liquid with surface tension of equal to or greater than 60 mN/m and equal to or less than 80 mN/m may be employed as the wiping solution.

Next, the impregnating solution with which the strip-shaped member 60 is impregnated will be described below in detail.

When the strip-shaped member 60 is impregnated with the impregnating solution, the pigment particles are more likely to move from the surface to the inside of the strip-shaped member 60, and the pigment particles are more unlikely to remain on the surface of the strip-shaped member 60. The impregnating solution preferably contains a penetrant and a humidifier. In this manner, the pigment particles are more likely to be absorbed by the strip-shaped member 60. Also, the impregnating solution is not particularly limited as long as the liquid can cause inorganic pigment particles to move from the surface to the inside of the strip-shaped member 60.

The surface tension of the impregnating solution is preferably equal to or less than 45 mN/m and equal to or less than 35 mN/m. When the surface tension is low, permeability of the inorganic pigment into the strip-shaped member 60 becomes satisfactory, and wiping properties are improved. As a method of measuring the surface tension, it is possible to exemplify a method of performing measurement at a liquid temperature of 25° C. by a Wilhelmy method using a surface tension meter that is typically used, for example, a surface tension meter CBVP-Z manufactured by Kyowa Interface Science, Inc. or the like.

The content of the impregnating solution is preferably equal to or greater than 10% by mass and equal to or less than 200% by mass and is more preferably equal to or greater than 50% by mass and equal to or less than 100% by mass with respect to 100% by mass of the strip-shaped member 60. By the content of the impregnating solution being equal to or greater than 10% by mass, the inorganic pigment ink is likely to penetrate to the inside of the strip-shaped member 60, and it is possible to further curb damage on a water-repellent film. Also, by the content of the impregnating solution being equal to or less than 200% by mass, it is possible to further curb remaining of the impregnating solution on the nozzle surface 40 and to further curb dot missing due to invasion of air bubbles with the impregnating solution into the nozzles 36 and dot missing due to invasion of the impregnating solution itself into the nozzles 36.

In addition, although additives that may be contained in the impregnating solution, that is, components of the impregnating solution are not particularly limited, examples thereof include a resin, an antifoaming agent, a surfactant, water, an organic solvent, a pH adjusting agent, and the like. The aforementioned components may be used alone or in combination of two or more thereof, and the content thereof is not particularly limited.

When the impregnating solution contains an antifoaming agent, it is possible to effectively prevent the impregnating solution remaining on the nozzle surface 40 after the cleaning treatment from foaming. Also, the impregnating solution may contain a large amount of acid humidifier such as polyethylene glycol or glycerin, and in such a case, it is typically possible to avoid contact of an acid impregnating solution with a basic ink composition with pH of equal to or greater than 7.5 when the impregnating solution contains a pH adjusting agent. In this manner, it is possible to prevent the ink composition from shifting on the acid side, and preservation stability of the ink composition is further maintained.

Also, any humidifier can be used as the humidifier that may be contained in the impregnating solution without particular limitation as long as the humidifier can typically be used in an ink or the like. Although the humidifier is not particularly limited, it is possible to use a high-boiling-point humidifier, the boiling point of which is preferably equal to or greater than 180° C. and is more preferably equal to or greater than 200° C. under 1 atm. When the boiling point falls within the aforementioned range, it is possible to prevent volatile components in the impregnating solution from being volatilized and to effectively perform wiping by reliably wetting the inorganic pigment-containing ink composition that is brought into contact with the impregnating solution.

The high-boiling-point humidifier is not particularly limited, and examples thereof include ethylene glycol, propylene glycol, diethylene glycol, triethylene glycol, pentamethylene glycol, trimethylene glycol, 2-butene-1,4-diol, 2-ethyl-1,3-hexanediol, 2-methyl-2,4-pentanediol, tripropylene glycol, polyethylene glycol, polypropylene glycol, 1,3-propylene glycol, isopropylene glycol, isobutylene glycol, glycerin, mesoerythritol, pentaerythritol, and the like.

The humidifiers may be used alone or as a mixture of two or more thereof. The content of the humidifier is preferably 10 to 100% by mass with respect to 100% by mass, which is the total mass of the impregnating solution. Also, the expression that the content of the humidifier is 100% by mass with respect to the total mass of the impregnating solution means that the component of the impregnating solution is only the humidifier.

A penetrant among the additives that may be contained in the impregnating solution will be described. Any penetrant can be used without particular limitation as long as the penetrant can typically be used in an ink or the like, and it is also possible to employ a solution containing 90% by mass of water and 10% by mass of penetrant with surface tension of equal to or less than 45 mN/m as the penetrant. Although the penetrant is not particularly limited, it is possible to exemplify at least one selected from the group consisting of alkanediols having 5 to 8 carbon atoms, glycol ethers, acetylene glycol-based surfactants, siloxane-based surfactants, and fluorine-based surfactants. Also, the measurement of the surface tension can be performed by the aforementioned method.

Also, the content of the penetrant in the impregnating solution is preferably equal to or greater than 1% by mass and equal to or less than 40% by mass and is further preferably equal to or greater than 3% by mass and equal to or less than 25% by mass. There is a trend that more excellent wiping properties are achieved by the content being equal to or greater than 1% by mass, and it is possible to avoid the penetrant attacking the pigment contained in the ink in the vicinity of the nozzles 36, breaking dispersion stability, and causing aggregation, by the content of the penetrant being equal to or less than 40% by mass.

Although the alkanediols having 5 to 8 carbon atoms are not particularly limited, examples thereof include 1,2-pentanediol, 1,5-pentanediol, 1,2-hexanediol, 1,6-hexanediol, 1,2-heptanediol, 2-ethyl-1,3-hexanediol, 2,2-dimethyl-1,3-propanediol, 2,2-dimethyl-1,3-hexanediol, and the like. The alkanediols having 5 to 8 carbon atoms may be used alone or in combination of two or more thereof.

Although the glycol ethers are not particularly limited, examples thereof include ethylene glycol mono-n-butyl ether, ethylene glycol mono-t-butyl ether, diethylene glycol mono-n-butyl ether, triethylene glycol mono-n-butyl ether, diethylene glycol mono-t-butyl ether, propylene glycol monomethyl ether, propylene glycol monoethyl ether, propylene glycol mono-t-butyl ether, propylene glycol mono-n-propyl ether, propylene glycol mono-iso-propyl ether, propylene glycol mono-n-butyl ether, dipropylene glycol mono-n-butyl ether, dipropylene glycol mono-n-propyl ether, dipropylene glycol mono-iso-propyl ether, diethylene glycol dimethyl ether, diethylene glycol diethyl ether, diethylene glycol dibutyl ether, diethylene glycol ethyl methyl ether, diethylene glycol butyl methyl ether, triethylene glycol dimethyl ether, tetraethylene glycol dimethyl ether, dipropylene glycol dimethyl ether, dipropylene glycol diethyl ether, tripropylene glycol dimethyl ether, ethylene glycol monoisohexyl ether, diethylene glycol monoisohexyl ether, triethylene glycol monoisohexyl ether, ethylene glycol monoisoheptyl ether, diethylene glycol monoisoheptyl ether, triethylene glycol monoisoheptyl ether, ethylene glycol monoisooctyl ether, diethylene glycol monoisooctyl ether, triethylene glycol monoisooctyl ether, ethylene glycol mono-2-ethyl hexyl ether, diethylene glycol mono-2-ethyl hexyl ether, triethylene glycol mono-2-ethyl hexyl ether, diethylene glycol mono-2-ethyl pentyl ether, ethylene glycol mono-2-ethyl pentyl ether, ethylene glycol mono-2-methyl pentyl ether, diethylene glycol mono-2-methyl pentyl ether, and the like. The glycol ethers may be used alone or in combination of two or more thereof.

Although the acetylene glycol-based surfactant is not particularly limited, examples thereof include compounds represented by the following formulae.

(1)

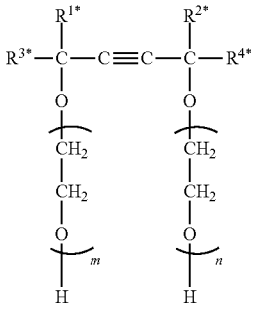

[In Formula (1), $0 \leq m+n \leq 50$, and $R^{1*}$, $R^{2*}$, $R^{3*}$, and $R^{4*}$ each independently represent an alkyl group and each preferably represent an alkyl group having 1 to 6 carbon atoms.]

Among the acetylene glycol-based surfactants represented by Formula (1), preferable examples include 2,4,7,9-tetramethyl-5-decyne-4,7-diol, 3,6-dimethyl-4-octyn-3,6-diol, 3,5-dimethyl-1-hexyne-3ol, and the like. Marketed products can also be used as the acetylene glycol-based surfactants represented by Formula (1), and specific examples thereof include Surfynol 82, 104, 440, 465, 485, and TG which are available from Air Products and Chemicals, Inc., Olfine STG manufactured by Nissin Chemical Co., Ltd., Olfine E1010 manufactured by Nissin Chemical Co., Ltd., and the like. The acetylene glycol-based surfactants may be used alone or in combination of two or more thereof.

Although the siloxane-based surfactants are not particularly limited, examples thereof include those represented by Formula (2) or (3) below.

(2)

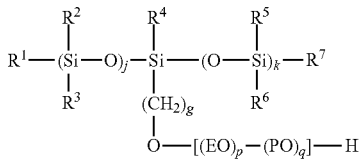

[In Formula (2), $R^1$, $R^2$, $R^3$, $R^4$, $R^5$, $R^6$, and $R^7$ each independently represent an alkyl group having 1 to 6 carbon atoms and preferably represents a methyl group. j and k each independently represent an integer that is equal to or greater than 1, preferably represent 1 to 5, more preferably represent 1 to 4, further preferably represent 1 or 2, and preferably satisfy j=k=1 or k=j+1. Also, g represents an integer that is equal to or greater than 0, preferably represents 1 to 3, and more preferably represents 1. Further, p and q each represent an integer that is equal to or greater than 0 and preferably represent 1 to 5. However, p+q is an integer that is equal to or greater than 1, and p+q is preferably 2 to 4.]

As the siloxane-based surfactants represented by Formula (2), a compound in which all of $R^1$ to $R^7$ represent methyl groups, j represents 1 or 2, k represents 1 or 2, g represents 1 or 2, p represents an integer that is equal to or greater than 1 and equal to or less than 5, and q is 0 is preferably used.

(3)

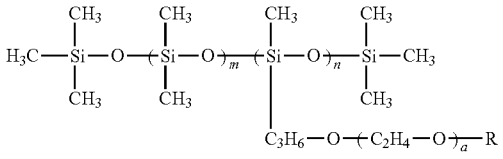

[In Formula (3), R represents a hydrogen atom or a methyl group, a represents an integer of from 2 to 18, m represents an integer of from 0 to 50, and n represents an integer of from 1 to 5.]

Although the siloxane-based surfactants represented by Formula (3) are not particularly limited, preferable examples thereof include compounds in which R represents a hydrogen atom or a methyl group, a represents an integer of from 7 to 11, m represents an integer of from 30 to 50, and n represents an integer of from 3 to 5, compounds in which R represents a hydrogen atom or a methyl group, a represents an integer of from 9 to 13, m represents an integer of from 2 to 4, and n is an integer that is 1 or 2, compounds in which R represents a hydrogen atom or a methyl group, a represents an integer of from 6 to 18, m represents an integer that is 0, and n represents an integer that is 1, and compounds in which R represents a hydrogen atom, a represents an integer of from 2 to 5, m represents an integer of from 20 to 40, and n represents an integer of from 3 to 5.

Commercially available marketed siloxane-based surfactants may also be used, and examples thereof include Olfine PD-501 manufactured by Nissin Chemical Co., Ltd., Olfine PD-570 manufactured by Nissin Chemical Co., Ltd., BYK-347 manufactured by BYK Japan KK, BYK-348 manufactured by BYK Japan KK, and the like. The aforementioned siloxane-based surfactants may be used alone or in combination of two or more thereof.

The fluorine-based surfactants are known as solvents that exhibit satisfactory wettability with respect to a low-absorbable or unabsorbable medium 14 as disclosed in WO2010/050618 and WO2011/007888. Although the fluorine-based surfactants are not particularly limited, any fluorine-based surfactant can appropriately be selected in accordance with purposes, and examples thereof include a perfluoroalkylsulfonic acid salt, a perfluoroalkylcarboxylic acid salt, a perfluoroalkylphosphoric acid ester, a perfluoroalkylethylene oxide adduct, perfluoroalkyl betaine, perfluoroalkylamine oxide compound, and the like.

In addition to the aforementioned examples, an appropriately synthesized one may be used, or a marketed product may be used, as the fluorine-based surfactant. Examples of the marketed product include S•144 and S•145 manufactured by AGC Inc.; FC•170C, FC•430, and Fluorad•FC4430 manufactured by 3M Japan Limited; FSO, FSO•100, FSN, FSN•100, and FS•300 manufactured by Dupont; FT•250 and 251 manufactured by Neos Company Limited; and the like. Among these, FSO, FSO•100, FSN, FSN•100, and FS•300 manufactured by Dupont are preferably employed. The fluorine-based surfactants may be used alone or in combination of two or more thereof.

Next, an ink that is a liquid used by the liquid ejecting portion 20 will be described below in detail.

The ink used by the liquid ejecting apparatus 11 contains a resin in the composition thereof and does not substantially contain glycerin with a boiling point of 290° C. under 1 atm. When the ink substantially contains glycerin, drying properties of the ink are significantly degraded. This not only leads to significant irregularity of concentration in an image on various media 14, particularly ink unabsorbable or low-absorbable media 14 but also makes it difficult to obtain ink fixability. Further preferably, the ink does not substantially contain alkyl polyols with a boiling point of equal to or higher than 280° C. under 1 atm, except for the aforementioned glycerin.

Here, "substantially not contain" in the specification means that the substance is not contained exceeding the amount with which addition has sufficient meaning. When this is quantitatively expressed, the content of glycerin is preferably not equal to or greater than 1.0% by mass, is more preferably not equal to or greater than 0.5% by mass, is further preferably not equal to or greater than 0.1% by mass, is still further preferably not equal to or greater than 0.05% by mass, and is particularly preferably not equal to or greater than 0.01% by mass with respect to 100% by mass, which is a total mass of the ink. Also, the content of glycerin is most preferably not equal to or greater than 0.001% by mass.

Liquid Repellency

A liquid repellent film may be formed on the nozzle surface 40. The liquid repellent films are not particularly limited as long as the films have liquid repellency. The liquid repellent films can be formed by forming metal alkoxide molecular films with liquid repellency and then performing drying processing, annealing processing, and the like thereon, for example. Although any metal alkoxide molecular films may be employed as long as the metal alkoxide molecular films have liquid repellency, it is desirable to employ single-molecular films of metal alkoxide having a long-chain polymer group (long-chain RF group) containing fluorine or single-molecular films of metal acid salts having a repellent group (for example, a long-chain polymer group containing fluorine). Although metal alkoxide is not particularly limited, types of metal typically used include, for example, silicon, titanium, aluminum, and zirconium. Examples of the long-chain RF groups include a perfluoroalkyl chain and a perfluoropolyether chain. Examples of alkoxysilane having the long-chain RF group include a silane coupling agent having the long-chain RF group. In addition, it is also possible to use, as the liquid repellent films, silane coupling agent (SCA) films and those disclosed in Japanese Patent No. 4424954, for example.

Although the conductive films may be formed on the surface of the cover member 38, and the liquid repellent films may be formed on the conductive films, underlayer films (plasma polymerized silicone (PPSi) films) may be formed through plasma polymerization of a silicone material first, and the liquid repellent films may be formed on the underlayer films. It is possible to allow the silicone material of the cover member 38 to conform to the liquid repellent films by interposing the underlayer films therebetween.

The liquid repellent films preferably have a thickness of equal to or greater than 1 nm and equal to or less than 30 nm. When the thickness falls within such a range, the cover member 38 is likely to have more excellent liquid repellency, degradation of the films is relatively delayed, and it is possible to maintain the liquid repellency in a longer period of time. Also, more excellent properties are achieved in terms of costs and easiness in forming the films. Also, the thickness is more preferably equal to or greater than 1 nm and equal to or less than 20 nm and is further preferably equal to or greater than 1 nm and equal to or less than 15 nm in terms of easiness in forming the films.

Ink Composition

Next, an ink composition containing an inorganic pigment (hereinafter, referred to as an inorganic pigment-containing ink composition) and additives (components) that are or may be contained in an ink composition containing a coloring material other than the inorganic pigment (hereinafter, referred to as an inorganic pigment non-containing ink composition) will be described. The ink composition is configured of a coloring material (an inorganic pigment, an organic pigment, a dye, or the like) a solvent (water, an organic solvent, or the like), a resin, a surfactant, and the like.

Coloring Material

The inorganic pigment-containing ink composition contains, as a coloring material, an inorganic pigment in a range of equal to or greater than 1.0% by mass and equal to or less than 20.0% by mass. When the inorganic pigment-containing ink composition is a white ink composition, in particular, the concentration of inorganic pigment is preferably equal to or greater than 5% by mass.

Also, an inorganic pigment non-containing ink composition may contain a coloring material selected from a pigment other than the inorganic pigment and a dye.

Pigment

An average particle diameter of the inorganic pigment contained in the inorganic pigment-containing ink composition is preferably equal to or greater than 20 nm and equal to or less than 250 nm and is more preferably equal to or greater than 20 nm and equal to or less than 200 nm.

Also, a needle shape ratio of the inorganic pigment is preferably equal to or less than 3.0. It is possible to satisfactorily protect the liquid repellent films according to the disclosure of the application by setting such a needle shape ratio. The needle shape ratio is a value obtained by dividing the maximum length of each particle by a minimum width (needle shape ratio=maximum length of particle/minimum width of particle). For specifying the needle shape ratio, it is possible to perform measurement using a transmission-type electronic microscope.

Also, Mohs hardness of the inorganic pigment exceeds 2.0 and is preferably equal to or greater than 5 and equal to or less than 8.

Examples of the inorganic pigment include single metal such as carbon black, gold, silver, copper, aluminum, nickel, and zinc; oxides such as cerium oxide, chromium oxide, aluminum oxide, zinc oxide, magnesium oxide, silicon oxide, tin oxide, zirconium oxide, iron oxide, and titanium oxide; sulfates such as calcium sulfate, barium sulfate, and aluminum sulfate; silicates such as calcium silicate and magnesium silicate; nitrides such as boron nitride and titanium nitride; carbides such as silicon carbide, titanium carbide, boron carbide, tungsten carbide, and zirconium carbide; borides such as zirconium boride and titanium boride; and the like. Examples of the inorganic pigments that are preferable among these include aluminum, aluminum oxide, titanium oxide, zinc oxide, zirconium oxide, silicon oxide, and the like. More preferable examples include titanium oxide, silicon oxide, and aluminum oxide. Rutile titanium oxide has Mohs hardness of about 7 to 7.5 while anatase titanium oxide has Mohs hardness of about 6.6 to 6. Rutile titanium oxide is a preferable crystal system due to low manufacturing costs, and it is also possible to exhibit satisfactory whiteness. Therefore, the liquid ejecting apparatus 11 that has liquid repellent film preservability and is capable of producing a recorded product with satisfactory whiteness at low costs can be obtained when rutile titanium dioxide is used.

Although the organic pigment is not particularly limited, examples thereof include a quinacridone-based pigment, a quinacridonequinone-based pigment, a dioxazine-based pigment, a phthalocyanine-based pigment, an anthrapyrimidine-based pigment, an anthanthrone-based pigment, an indanthrone-based pigment, a flavanthrone-based pigment, a perylene-based pigment, a diketopyrrolopyrrole-based pigment, a perinone-based pigment, a quinophthalone-based pigment, an anthraquinone-based pigment, a thioindigo-based pigment, a benzimidazolone-based pigment, an isoindolinone-based pigment, an azomethine-based pigment, an azo-based pigment, and the like. Specific examples of the organic pigment are listed below.

Examples of a pigment that is used in a cyan ink include C.I. Pigment Blue 1, 2, 3, 15, 15:1, 15:2, 15:3, 15:4, 15:6, 15:34, 16, 18, 22, 60, 65, 66, C.I. Vat Blue 4 and 60, and the like. Among these, at least either C.I. Pigment Blue 15:3 or 15:4 is preferably employed.

Examples of a pigment that is used in a magenta ink include C.I. Pigment Red 1, 2, 3, 4, 5, 6, 7, 8, 9, 10, 11, 12, 14, 15, 16, 17, 18, 19, 21, 22, 23, 30, 31, 32, 37, 38, 40, 41, 42, 48 (Ca), 48 (Mn), 57 (Ca), 57:1, 88, 112, 114, 122, 123, 144, 146, 149, 150, 166, 168, 170, 171, 175, 176, 177, 178, 179, 184, 185, 187, 202, 209, 219, 224, 245, 254, and 264, C.I. Pigment Violet 19, 23, 32, 33, 36, 38, 43, and 50, and the like. Among these, at least one selected from the group consisting of C.I. Pigment Red 122, C.I. Pigment Red 202, and C.I. Pigment Violet 19 are preferably employed.

Examples of a pigment used in a yellow ink include C.I. Pigment Yellow 1, 2, 3, 4, 5, 6, 7, 10, 11, 12, 13, 14, 16, 17, 24, 34, 35, 37, 53, 55, 65, 73, 74, 75, 81, 83, 93, 94, 95, 97, 98, 99, 108, 109, 110, 113, 114, 117, 120, 124, 128, 129, 133, 138, 139, 147, 151, 153, 154, 155, 167, 172, 180, 185, and 213 and the like. Among these, at least one selected from the group consisting of C.I. Pigment Yellow 74, 155, and 213 are preferably employed.

Also, examples of a pigment used in an ink of a color other than the aforementioned colors, such as a green ink or an orange ink, include ones that are known in the related art.

An average particle diameter of the pigment other than the inorganic pigment is preferably equal to or less than 250 nm since it is possible to curb clogging of the nozzles 36 and to achieve further satisfactory ejection stability.

Also, the average particle diameter in the specification is based on volume. As a measurement method, it is possible to perform the measurement using a granularity distribution measurement device employing a laser diffraction scattering method as a measurement principle, for example. Examples of the granularity distribution measurement device include a granularity distribution meter (for example, Microtrac UPA manufactured by Nikkiso Co., Ltd.) employing a dynamic light scattering method as a measurement principle.

Dye

It is possible to use a dye as the coloring material. The dye is not particularly limited, and it is possible to use an acidic dye, a direct dye, a reactive dye, and a basic dye.

The content of the coloring material is preferably 0.4 to 12% by mass and is more preferably 2 to 5% by mass with respect to the total mass (100% by mass) of the ink composition.

Resin

Examples of the resin include a resin dispersant, a resin emulsion, a wax, and the like. Among these, an emulsion is preferably employed due to its satisfactory adhesiveness and rubbing resistance.

The inorganic pigment-containing ink composition preferably has the following feature 1. or 2. in terms of the composition.

1. The ink jet recording ink composition contains a first resin with a thermal deformation temperature of equal to or lower than 10° C. (hereinafter, referred to as a "first ink").

2. The ink jet recording ink composition contains a second resin and substantially does not contain glycerin (hereinafter, referred to as a "second ink").

Although these ink compositions have a characteristic that the ink compositions are likely to be solidified on the nozzle surface 40 and the strip-shaped member 60, and are likely to promote damage on the liquid repellent films, it is possible to satisfactorily prevent such trends according to the disclosure of the present application.

The aforementioned first ink contains the first resin with the thermal deformation temperature of equal to or lower than 10° C. Such a resin has a characteristic that the resin fixedly adheres to a material with high flexibility and high absorbability such as a fabric. Meanwhile, film coating and solidification rapidly advance, and the resin adheres, as a solid, to the nozzle surface 40, the strip-shaped member 60, and the like.

The aforementioned second ink substantially does not contain glycerin with a boiling point of 290° C. under 1 atm. When the colored ink substantially contains glycerin, drying properties of the ink are significantly degraded. As a result, not only significant irregularity of concentration in an image on various media 14, particularly ink unabsorbable or low-absorbable media 14 is achieved, but also ink fixability cannot be obtained. Also, when glycerin is not contained, water and the like as a main solvent in the ink is rapidly volatilized, and the proportion of the organic solvent in the second ink increases. In this case, the thermal deformation temperature (particularly, a film increasing temperature) of the resin is lowered as a result, and solidification due to coated film is further promoted. Further preferably, the colored ink substantially does not contain alkylpolyols (except for glycerin described above) with a boiling point of equal to or higher than 280° C. under 1 atm. Although in the case of the second ink, drying of the ink around the liquid ejecting portion 20 advances, and the problem further significantly appears in a case of the liquid ejecting apparatus 11 provided with a heating mechanism configured to heat the medium 14 that has been transported to a position that faces the liquid ejecting portion 20, it is possible to satisfactorily prevent this according to the disclosure of the application. The heating temperature is preferably equal to or greater than 30° C. and equal to or less than 80° C. in terms of ink preservation stability and recorded image quality. The heating mechanism is not particularly limited, and examples thereof include a heat generating heater, a hot wind heater, an infrared heater, and the like.

Here, "substantially not contain" in the specification means that the substance is not contained exceeding the amount with which addition has sufficient meaning. When this is quantitatively expressed, the content of glycerin is preferably not equal to or greater than 1.0% by mass, is more preferably not equal to or greater than 0.5% by mass, is further preferably not equal to or greater than 0.1% by mass, is still further preferably not equal to or greater than 0.05% by mass, is particularly preferably not equal to or greater than 0.01% by mass, and is most preferably not equal to or greater than 0.001% by mass with respect to the total mass (100%) by mass of the colored ink.

A thermal deformation temperature of the first resin is equal to or lower than 10° C. Further, the thermal deformation temperature is preferably equal to or lower than −10° C. and is more preferably equal to or less than −15° C. When a glass transition temperature of a fixation resin falls within the aforementioned range, further excellent fixability of the pigment in a recorded product is achieved, and as a result, excellent rubbing resistance is achieved. Also, although a lower limit of the thermal deformation temperature is not particularly limited, the lower limit may be equal to or greater than −50° C.

A lower limit of the thermal deformation temperature of the second resin is preferably equal to or higher than 40° C. and is more preferably equal to or higher than 60° C. in order to reduce clogging of the head and to achieve satisfactory rubbing resistance of the recorded product. A preferable upper limit is equal to or lower than 100° C.

Here, the "thermal deformation temperature" in the specification is assumed to be a temperature value represented by a glass transition temperature (Tg) or a minimum film forming temperature (MFT). In other words, "the thermal deformation temperature of equal to or higher than 40° C." means that it is only necessary for either Tg or MFT to be equal to or higher than 40° C. Also, since it is easier to recognize relative merits of re-dispersibility of the resin with MFT than with Tg, the thermal deformation temperature is preferably a temperature value represented by MFT. Since the ink composition with excellent resin re-dispersibility does not adhere in a solidified manner, the head is unlikely to cause clogging.

As Tg in the specification, a value measured by differential scanning calorimetry will be described. Also, a value measured based on ISO 2115:1996 (title: plastic-polymer dispersion-measurement of white point temperature and minimum film forming temperature) will be described as MFT in the specification.

Resin Dispersant

In order for the pigment to be stably dispersed and held in water when the ink composition contains the aforementioned pigment, it is better for the ink composition to contain a resin dispersant. By the ink composition containing the pigment dispersed using the resin dispersant, such as a water-soluble resin or a water dispersible resin (hereinafter, referred to as a "resin dispersed pigment"), it is possible to obtain satisfactory adhesiveness at least either between the medium 14 and the ink composition or between solidified substances in the ink composition when the ink composition adheres to the medium 14. The water-soluble resin is preferably employed among the resin dispersants due to its excellent dispersion stability.

Resin Emulsion

The ink composition may contain a resin emulsion. The resin emulsion exhibits an effect that the ink composition is sufficiently fixed to the medium 14 and satisfactory rubbing resistance of the image is achieved, by forming a resin coating film. A recorded product recorded using the ink composition containing the resin emulsion has excellent adhesiveness and rubbing resistance on a cloth or an ink unabsorbable or low-absorbable medium 14, in particular, due to the aforementioned effect. Meanwhile, although the resin emulsion is likely to promote solidification of the inorganic pigment, it is possible to satisfactorily prevent a problem of degradation of the liquid repellent films, which occurs when a solidified adhering substance is wiped off, according to the disclosure of the application.

Also, the resin emulsion that serves as a binder is preferably contained in an emulsion form in the ink composition. The viscosity of the ink composition is easily adjusted in a proper range in the ink jet recording scheme, and excellent preservation stability and ejection stability of the ink composition are achieved by containing the resin that serves as a binder in an emulsion form in the ink composition.

Although the resin emulsion is not particularly limited, examples thereof include (meth)acrylic acid, (meth)acrylic acid ester, acrylonitrile, cyanoacrylate, acrylamide, olefin, styrene, vinyl acetate, vinyl chloride, vinyl alcohol, vinyl ether, vinyl pyrrolidone, vinyl pyridine, vinyl carbazole, vinyl imidazole, a single polymer or a copolymer of vinylidene chloride, a fluorine resin, a natural resin, and the like. Among these, at least either a (meth)acrylic resin or styrene-(meth)acrylic acid copolymer-based resin is preferably employed, at least either the acrylic resin or a styrene-acrylic acid copolymer-based resin is more preferably employed, and a styrene-acrylic acid copolymer-based resin is further preferably employed. Also, the aforementioned copolymer may be in any form among a random copolymer, a block copolymer, an alternating copolymer, and a graft copolymer.

As the resin emulsion, a marketed product may be used, or the resin emulsion may be produced using an emulsion polymerization method or the like as follows. As a method for obtaining a resin in an emulsion state in the ink composition, it is possible to exemplify a method of emulsifying and polymerizing a monomer of the aforementioned water-soluble resin in water in which a polymerization catalyst and an emulsifier are present. A polymerization initiator, an emulsifier, and a molecular weight adjusting agent used for emulsification polymerization can be used in accordance with a method that is known in the related art.

An average particle diameter of the resin emulsion is preferably within a range of 5 nm to 400 nm and is more preferably within a range of 20 nm to 300 nm in order to achieve further satisfactory ink preservation stability and ejection stability.

The resin emulsions may be used alone or in combination of two or more thereof. The content of the resin emulsion in the resin is preferably within a range of 0.5 to 15% by mass with respect to the total mass (100% by mass) of the ink composition. When the content falls within the aforementioned range, it is possible to reduce the concentration of the solid content and thereby to achieve further satisfactory ejection stability.

Wax

The ink composition may contain a wax. The ink composition have more excellent fixability on the ink unabsorbable and low-absorbable media 14 by containing the wax. Among waxes, a wax of an emulsion type or a suspension type is more preferably employed. Preferable examples of the wax include a polyethylene wax, a paraffin wax, and a polypropylene wax, and in particular, a polyethylene wax, which will be described later, is preferably employed although not limited thereto.

It is possible to achieve excellent ink rubbing resistance by the ink composition containing a polyethylene wax.

An average particle diameter of the polyethylene wax is preferably within a range of 5 nm to 400 nm and is more preferably within a range of 50 nm to 200 nm in order to achieve further satisfactory ink preservation stability and ejection stability.

The content (in terms of solid content) of polyethylene wax is preferably within a range of 0.1 to 3% by mass, is more preferably within a range of 0.3 to 3% by mass, and is further preferably within a range of 0.3 to 1.5% by mass with respect to the total mass (100% by mass) of the ink composition. When the content falls within the aforementioned range, it is possible to satisfactorily solidify and fix the ink composition on and to the medium 14 and to achieve more excellent ink preservation stability and ejection stability.

Antifoaming Agent

The ink composition may contain an antifoaming agent. More specifically, at least either the ink composition or the impregnating solution may contain the antifoaming agent. When the ink composition contain the antifoaming agent, it is possible to curb foaming and, as a result, to reduce the concern that foam enters the nozzles 36.

Examples of the antifoaming agent include a silicone-based antifoaming agent, a polyether-based antifoaming agent, an aliphatic acid ester-based antifoaming agent, an acetylene glycol-based antifoaming agent, and the like although not limited thereto. Among these, the silicone-based antifoaming agent or an acetylene glycol-based antifoaming agent is preferably employed since they have excellent ability of appropriately keeping the surface tension and interfacial tension and substantially no air bubbles are generated. Also, an HLB value of the antifoaming agent based on a Griffin method is more preferably equal to or less than 5.

Surfactant

The ink composition may include surfactants (excluding those listed in the above antifoaming agents, that is, the HLB value by the Griffin method is limited to more than 5). Examples of the surfactant include nonionic surfactants although not limited to those listed below. The nonionic surfactants have an effect of uniformly spreading the ink on the medium 14. Therefore, it is possible to obtain a fine image with substantially no bleeding when ink jet recording is performed using an ink containing a nonionic surfactant. Examples of such a nonionic surfactant include a silicone-based surfactant, a polyoxyethylene alkyl ether-based surfactant, a polyoxypropylene alkyl ether-based surfactant, a polycyclic phenyl ether-based surfactant, a sorbitan derivative, a fluorine-based surfactant, and the like although not limited thereto, and among these, a silicone-based surfactant is preferably employed.

The silicone-based surfactant has an excellent effect of uniformly spreading the ink such that no bleeding occurs on the medium 14 compared with other nonionic surfactants.

The surfactants may be used alone or as a mixture of two or more thereof. The content of the surfactant is preferably equal to or greater than 0.1% by mass and equal to or less than 3% by mass with respect to the total mass (100% by mass) of the ink since further satisfactory ink preservation stability and ejection stability are achieved.

Water

The ink composition may contain water. When the ink composition is a water-based ink, in particular, water is a main solvent of the ink, and the component is evaporated and flies over when the medium 14 is heated in ink jet recording.

Examples of water include pure water such as ion exchanged water, ultrafiltration water, reverse osmotic water, and distilled water and water from which ionic impurities have been removed to the maximum extent, such as ultrapure water. Also, when water sterilized by irradiation with ultraviolet rays, addition of hydrogen peroxide, or the like is used, it is possible to prevent mold and bacteria from being generated when the pigment dispersion and the ink using it are preserved for a long period of time.

The content of water is not particularly limited and may appropriately be determined as needed.

Surface Tension of Ink Composition

Surface tension of the ink composition is not particularly limited and is preferably 15 to 35 mN/m. In this manner, it is possible to secure permeability of the ink composition into the strip-shaped member 60 and bleeding preventing properties at the time of recording, and ink wiping properties at the time of a cleaning operation is improved. The surface tension of the ink composition can be also measured by using, for example, a typically used surface tension meter (for example, a surface tension meter CBVP-Z manufactured by Kyowa Interface Science, Inc. or the like) as described above. Also, a difference between the surface tension of the ink composition and the surface tension of the cleaning solution is preferably in a relationship within 10 mN/m. In this manner, it is possible to prevent the surface tension of the ink composition from extremely decreasing when both the ink composition and the cleaning solution are mixed around the nozzles 36.

Hereinafter, technical ideas and effects and advantages thereof that can be understood from the aforementioned embodiments and modification examples will be described.

A. A liquid ejecting apparatus includes: a liquid ejecting portion configured to eject a liquid from a nozzle disposed in a nozzle surface; a wiping mechanism configured to perform a wiping operation of wiping the nozzle surface by moving a strip-shaped member configured to absorb the liquid ejected by the liquid ejecting portion relative to the nozzle surface in a state in which the strip-shaped member is in contact with the nozzle surface; and a control portion configured to perform a pre-wiping operation of moving the strip-shaped member relative to the nozzle surface at a speed higher than a speed for the relative movement during the wiping operation in a state in which the strip-shaped member is not in contact with the nozzle surface and is configured to be brought into contact with the liquid adhering to the nozzle surface, prior to the wiping operation of wiping the nozzle surface with the strip-shaped member.

With this configuration, the control portion successively performs the pre-wiping operation and the wiping operation by relatively moving the strip-shaped member and the nozzle surface. In the pre-wiping operation, the strip-shaped member and the nozzle surface are relatively moved at a speed higher than that for the wiping operation. The time required for the pre-wiping operation is shorter than the time required for the wiping operation. The time required when the pre-wiping operation and the wiping operation are successively performed is shorter than the time required when the wiping operation is successively performed. Therefore, it is possible to reduce the time that increases when wiping of the nozzle surface is performed a plurality of times.

B. In the liquid ejecting apparatus, the control portion may perform, after the pre-wiping operation, the wiping operation by moving the strip-shaped member relative to the nozzle surface in a direction opposite to a direction of the relative movement during the pre-wiping operation.

When the directions in which the strip-shaped member and the nozzle surface relatively move are the same in the pre-wiping operation and the wiping operation, it is necessary to perform the wiping operation after the pre-wiping operation is performed and the strip-shaped member and the nozzle surface are then returned to the original positions. In this regard, the direction in which the strip-shaped member and the nozzle surface relatively move in the pre-wiping operation and the direction in which the strip-shaped member and the nozzle surface relatively move in the wiping operation are opposite in this configuration. Therefore, the strip-shaped member and the nozzle surface can relatively move for the wiping operation from the positions at which the pre-wiping operation is complete, and it is possible to efficiently perform the pre-wiping operation and the wiping operation.

C. In the liquid ejecting apparatus, when the operation of performing the pre-wiping operation prior to the wiping operation is defined as a first wiping-off operation, the control portion may perform a second wiping-off operation of performing the wiping operation without performing the pre-wiping operation in a case in which the amount of the liquid adhering to the nozzle surface is smaller than the amount thereof when the first wiping-off operation is performed.

When the amount of liquid adhering to the nozzle surface is small, the liquid adhering to the nozzle surface may be sufficiently wiped only through the wiping operation. In this regard, the control portion performs the wiping operation without performing the pre-wiping operation when the amount of liquid adhering to the nozzle surface is small in this configuration. Therefore, it is possible to efficiently perform the wiping in accordance with the state of the nozzle surface.

D. In the liquid ejecting apparatus, the wiping mechanism may be configured to perform a winding operation of winding the strip-shaped member to allow an unused portion of the strip-shaped member to be brought into contact with the nozzle surface, and when the operation of performing the pre-wiping operation prior to the wiping operation is defined as a first wiping-off operation, the control portion may perform a third wiping-off operation of performing the pre-wiping operation, the winding operation, and then the wiping operation in a case in which the amount of the liquid adhering to the nozzle surface is larger than the amount thereof when the first wiping-off operation is performed.

When the amount of liquid adhering to the nozzle surface is large, the liquid cannot be sufficiently wiped off through the pre-wiping operation and the wiping operation. In this regard, the control portion performs the pre-wiping operation, the winding operation, and the wiping operation in order when the amount of liquid adhering to the nozzle surface is large in this configuration. A portion of the strip-shaped member that has absorbed the liquid in the pre-wiping operation is wound in the winding operation. In other words, it is possible to reduce the liquid remaining on the nozzle surface even when the amount of liquid adhering to the nozzle surface is large by performing the wiping operation using a portion of the strip-shaped member that is different from the portion used in the pre-wiping operation.

E. A maintenance method for a liquid ejecting apparatus including a liquid ejecting portion configured to eject a liquid from a nozzle disposed in a nozzle surface, and a wiping mechanism configured to perform a wiping operation of wiping the nozzle surface by moving a strip-shaped member configured to absorb the liquid ejected by the liquid ejecting portion relative to the nozzle surface in a state in which the strip-shaped member is in contact with the nozzle surface, the method includes, prior to the wiping operation of wiping the nozzle surface with the strip-shaped member, performing a pre-wiping operation of moving the strip-shaped member relative to the nozzle surface at a speed higher than a speed for the relative movement during the wiping operation in a state in which the strip-shaped member is not in contact with the nozzle surface and is configured to be brought into contact with the liquid adhering to the nozzle surface. According to this method, it is possible to achieve effects similar to those of the aforementioned liquid ejecting apparatus.

F. In the maintenance method for a liquid ejecting apparatus, the wiping operation may be performed, after the pre-wiping operation, by moving the strip-shaped member relative to the nozzle surface in a direction opposite to a direction of the relative movement during the pre-wiping operation. According to this method, it is possible to achieve effects similar to those of the aforementioned liquid ejecting apparatus.

G. In the maintenance method for a liquid ejecting apparatus, when the operation of performing the pre-wiping operation prior to the wiping operation is defined as a first wiping-off operation, a second wiping-off operation of performing the wiping operation without performing the pre-wiping operation may be performed in a case in which the amount of the liquid adhering to the nozzle surface is smaller than the amount thereof when the first wiping-off operation is performed. According to this method, it is possible to achieve effects similar to those of the aforementioned liquid ejecting apparatus.

H. In the maintenance method for a liquid ejecting apparatus, the wiping mechanism may be configured to perform a winding operation of winding the strip-shaped member to allow an unused portion of the strip-shaped member to be brought into contact with the nozzle surface, and when the operation of performing the pre-wiping operation prior to the wiping operation is defined as a first wiping-off operation, a third wiping-off operation of performing the pre-wiping operation, allowing the unused portion of the strip-shaped member to be brought into contact with the nozzle surface, and then performing the wiping operation may be performed in a case in which the amount of the liquid adhering to the nozzle surface is larger than the amount thereof when the first wiping-off operation is performed. According to this method, it is possible to achieve effects similar to those of the aforementioned liquid ejecting apparatus.

What is claimed is:

1. A liquid ejecting apparatus comprising:

a liquid ejecting portion configured to eject a liquid from a nozzle disposed in a nozzle surface;

a wiping mechanism configured to perform a wiping operation or a pre-wiping operation, wherein during the wiping operation, a strip-shaped member is in contact with the nozzle surface and configured to move relative to the nozzle surface at a first speed to absorb the liquid that is discharged from the liquid ejecting portion and adhered to the nozzle surface, and during the pre-wiping operation, the strip-shaped member moves toward the nozzle surface and is configured to move relative to the nozzle surface at a second speed that is greater than the first speed; and a control portion configured to control the wiping mechanism to perform the pre-wiping operation or the wiping operation, wherein when the pre-wiping operation and the wiping operation are both performed, the pre-wiping operation is performed before the wiping operation.

2. The liquid ejecting apparatus according to claim 1, wherein the control portion performs, after the pre-wiping operation, the wiping operation by moving the strip-shaped member relative to the nozzle surface in a direction opposite to a direction of the relative movement during the pre-wiping operation.

3. The liquid ejecting apparatus according to claim 1, wherein, as a first wiping-off operation, the control portion is configured to control the wiping mechanism to perform both the pre-wiping operation and the wiping operation, as a second wiping-off operation, the control portion is configured to control the wiping mechanism to perform the wiping operation without performing the pre-wiping operation, and the second wiping-off operation is performed in a case in which an amount of the liquid, that is ejected and discharged from the liquid ejecting portion and adhered to the nozzle surface, is smaller than a predetermined amount.

4. The liquid ejecting apparatus according to claim 3, wherein, the control portion is configured to perform cleaning to discharge a liquid from the nozzle for a purpose of maintenance of the liquid ejecting portion, the first wiping-off operation is performed after the cleaning is performed, the second wiping-off operation is performed after the liquid ejecting portion ejects a liquid from the nozzle onto a medium to perform printing.

5. The liquid ejecting apparatus according to claim 1, wherein the wiping mechanism is configured to perform a winding operation of winding the strip-shaped member to allow an unused portion of the strip-shaped member to be brought into contact with the nozzle surface, as a first wiping-off operation, the control portion is configured to control the wiping mechanism to perform both the pre-wiping operation and the wiping operation, as a third wiping-off operation, the control portion is configured to control the wiping mechanism to perform the pre-wiping operation, the winding operation and the wiping operation in order, and the third wiping-off operation is performed in a case which an amount of the liquid, that is discharged from the liquid ejecting portion and adhered to the nozzle surface, is greater than a predetermined amount.

6. The liquid ejecting apparatus according to claim 5, wherein, the control portion is configured to perform cleaning to discharge a liquid from the nozzle for a purpose of maintenance of the liquid ejecting portion, the control portion is configured to perform discharge cleaning to discharge a liquid from the nozzle, in order to empty an inside of the liquid ejecting portion, for a purpose of maintenance of the liquid ejecting portion, the first wiping-off operation is performed after the cleaning is performed, and the third wiping-off operation is performed after the discharge cleaning is performed.

7. A maintenance method for a liquid ejecting apparatus including a liquid ejecting portion configured to eject a liquid from a nozzle disposed in a nozzle surface, and a wiping mechanism configured to perform a wiping operation or a pre-wiping operation, wherein during the wiping operation, a strip-shaped member is in contact with the nozzle surface and configured to move relative to the nozzle surface at a first speed to absorb the liquid that is discharged from the liquid ejecting portion and adhered to the nozzle surface, and during the pre-wiping operation, the strip-shaped member moves toward the nozzle surface and configured to move relative to the nozzle surface at a second speed that is greater than the first speed, the method comprising:

performing the pre-wiping operation, or performing the wiping operation, wherein the pre-wiping operation and the wiping operation are both performed, the pre-wiping operation is performed prior to the wiping operation.

8. The maintenance method for a liquid ejecting apparatus according to claim 7, wherein the wiping operation is performed, after the pre-wiping operation, by moving the strip-shaped member relative to the nozzle surface in a direction opposite to a direction of the relative movement during the pre-wiping operation.

9. The maintenance method for a liquid ejecting apparatus according to claim 7, wherein, as a first wiping-off operation, both the pre-wiping operation and the wiping operation are configured to be performed, as a second wiping-off operation, the wiping operation is configured to be performed without the pre-wiping operation, and the second wiping-off operation is performed in a case in which an amount of the liquid, that is ejected and discharged from the liquid ejecting portion and a to the nozzle surface, is smaller than a determined amount.

10. The maintenance method for a liquid ejecting apparatus according to claim 9, wherein the first wiping-off operation is performed after cleaning is performed, the second wiping-off operation is performed after the liquid ejecting portion ejects a liquid from the nozzle onto a medium to perform printing, and the cleaning includes discharging a liquid from the nozzle for a purpose of maintenance of the liquid ejecting portion.

11. The maintenance method for a liquid ejecting apparatus according to claim 7, wherein the wiping mechanism is configured to perform a winding operation of winding the strip-shaped member to allow an unused portion of the strip-shaped member to be brought into contact with the nozzle surface, as a first wiping-off operation both the pre-wiping operation, the wiping operation are performed, as a third wiping-off operation, the pre-wiping operation, the winding operation and the wiping operation are performed in order, and the third wiping-off operation is performed in a case in which an amount of the liquid, that is discharged from the liquid ejecting portion and adhered to the nozzle surface, is greater than a predetermined amount.

12. The maintenance method for a liquid ejecting apparatus according to claim 11, wherein the first wiping-off operation is performed after cleaning is performed, the third wiping-off operation is performed after discharge cleaning is performed, the cleaning includes discharging a liquid from the nozzle for a purpose of maintenance of the liquid ejecting portion, and the discharge cleaning includes discharging a liquid from the nozzle, in order to empty an inside of the liquid ejecting portion, for a purpose of maintenance of the liquid ejecting portion.

* * * * *